US008923529B2

(12) United States Patent
McCowan

(10) Patent No.: US 8,923,529 B2
(45) Date of Patent: Dec. 30, 2014

(54) MICROPHONE ARRAY SYSTEM AND METHOD FOR SOUND ACQUISITION

(75) Inventor: Iain Alexander McCowan, Southport (AU)

(73) Assignee: Biamp Systems Corporation, Beaverton, OR (US)

( * ) Notice: Subject to any disclaimer, the term of this patent is extended or adjusted under 35 U.S.C. 154(b) by 778 days.

(21) Appl. No.: 13/061,359

(22) PCT Filed: Aug. 26, 2009

(86) PCT No.: PCT/AU2009/001100
§ 371 (c)(1),
(2), (4) Date: Feb. 28, 2011

(87) PCT Pub. No.: WO2010/022453
PCT Pub. Date: Mar. 4, 2010

(65) Prior Publication Data

US 2011/0164761 A1 Jul. 7, 2011

(30) Foreign Application Priority Data

Aug. 29, 2008 (AU) ..... 2008904477

(51) Int. Cl.
*H04H 60/04* (2008.01)
*H04R 3/00* (2006.01)

(52) U.S. Cl.
CPC ..... *H04R 3/005* (2013.01)
USPC ..... 381/92; 381/122

(58) Field of Classification Search
USPC ..... 381/92, 122, 73.1, 94.1–94.3
See application file for complete search history.

(56) References Cited

U.S. PATENT DOCUMENTS 4,254,417 A 3/1981 Speiser
4,262,170 A 4/1981 Bauer ..... 179/1

(Continued)

FOREIGN PATENT DOCUMENTS

DE 3512155 A1 10/1985
EP 0 781 070 A1 6/1997

(Continued)

OTHER PUBLICATIONS

International Search Report from corresponding PCT/AU2009/00100 dated Jan. 18, 2010.

(Continued)

*Primary Examiner* — Duc Nguyen
*Assistant Examiner* — George Monikang
(74) *Attorney, Agent, or Firm* — Ohlandt, Greeley, Ruggiero & Perle, L.L.P.

(57) ABSTRACT

A microphone array system (16) for sound acquisition from multiple sound sources in a reception space surrounding a microphone array (18) that is interfaced with a beamformer module (28) is disclosed. The microphone array (18) includes microphone transducers (22) that are arranged relative to each other in N-fold rotationally symmetry, and the beamformer includes beamformer weights that are associated with one of a plurality of spatial reception sectors corresponding to the N-fold rotational symmetry of the microphone array (18). Microphone indexes of the microphone transducers (18) are arithmetically displaceable angularly about the vertical axis during a process cycle, so that a same set of beamformer weights is used selectively for calculating a beamformer output signal associated with any one of the spatial reception sectors. A sound source location module (30) is also disclosed that includes a modified steered power response sound source location method. A post filter module (32) for a microphone array system is also disclosed.

20 Claims, 9 Drawing Sheets

(56) References Cited

U.S. PATENT DOCUMENTS

| | | | | |
|---|---|---|---|---|
| 4,311,874 | A | 1/1982 | Wallace, Jr. | 179/1 |
| 4,675,906 | A | 6/1987 | Sessler et al. | 381/92 |
| 4,752,961 | A | 6/1988 | Kahn | 381/92 |
| 4,802,227 | A | 1/1989 | Elko et al. | 381/92 |
| 5,506,908 | A | 4/1996 | Baumhauer, Jr. et al. | 381/92 |
| 6,041,127 | A | 3/2000 | Elko | 381/92 |
| 6,198,693 | B1 | 3/2001 | Marash | |
| 6,847,403 | B1 | 1/2005 | Forsberg, Jr. et al. | 348/373 |
| 6,868,045 | B1 | 3/2005 | Schröder | 367/198 |
| 6,980,485 | B2 | 12/2005 | McCaskill | 367/119 |
| 7,065,220 | B2 | 6/2006 | Warren et al. | 381/92 |
| 7,068,801 | B1 | 6/2006 | Stinson et al. | 381/160 |
| 7,092,882 | B2 | 8/2006 | Arrowood et al. | 704/233 |
| 7,203,132 | B2 | 4/2007 | Berger | 367/129 |
| 7,251,336 | B2 | 7/2007 | Amiri et al. | 381/92 |
| 7,292,833 | B2 | 11/2007 | Marro et al. | |
| 7,415,117 | B2 | 8/2008 | Tashev et al. | 381/92 |
| 7,428,000 | B2 | 9/2008 | Cutler et al. | 348/14.11 |
| 7,565,288 | B2 | 7/2009 | Acero et al. | 704/226 |
| 7,630,503 | B2 | 12/2009 | Schulz et al. | |
| 7,634,533 | B2 | 12/2009 | Rudolph et al. | 709/203 |
| 7,643,641 | B2 | 1/2010 | Haulick et al. | 381/92 |
| 7,809,145 | B2 | 10/2010 | Mao | |
| 7,831,035 | B2 | 11/2010 | Stokes et al. | 379/406.01 |
| 7,840,013 | B2 | 11/2010 | Dedieu et al. | 381/122 |
| 8,237,770 | B2 | 8/2012 | Kenoyer et al. | |
| 2003/0103632 | A1 | 6/2003 | Goubran et al. | 381/73.1 |
| 2003/0161485 | A1 | 8/2003 | Smith | 381/92 |
| 2004/0041902 | A1 | 3/2004 | Washington | 348/14.01 |
| 2004/0165735 | A1 | 8/2004 | Opitz | 381/92 |
| 2005/0084116 | A1 | 4/2005 | Schulz et al. | |
| 2006/0256983 | A1 | 11/2006 | Kenoyer et al. | |
| 2009/0012779 | A1 * | 1/2009 | Ikeda et al. | 704/205 |

FOREIGN PATENT DOCUMENTS

| | | | |
|---|---|---|---|
| EP | 1 065 909 | A2 | 6/2000 |
| EP | 1 377 041 | A2 | 1/2004 |
| EP | 1 571 875 | A2 | 9/2005 |
| EP | 1 856 948 | A0 | 11/2007 |
| JP | 2007-28391 | A | 2/2007 |
| JP | 2007-89058 | A | 4/2007 |
| WO | 00/49602 | A1 | 8/2000 |
| WO | 01/31972 | A1 | 5/2001 |
| WO | 01/58209 | A1 | 8/2001 |
| WO | 03/075605 | A1 | 9/2003 |
| WO | 03/086009 | A1 | 10/2003 |
| WO | 2004/084577 | A1 | 9/2004 |
| WO | 2006/096959 | A1 | 9/2006 |
| WO | 2007/088730 | A1 | 8/2007 |
| WO | 2008/040991 | A2 | 4/2008 |

OTHER PUBLICATIONS

IPRP from corresponding PCT/AU2009/00100 dated Aug. 26, 2010.

Cohen, et al., "*Microphone Array Post-Filtering for Non-Stationary Noise Suppression*", Acoustics, Speech, and Signal Processing, 2002, Proceedings ICASSP'02 IEEE International Conference vol. 1, 4 pps.

Cutler, et al., "*Distributed Meetings: A Meeting Capture and Broadcasting System*", Proceedings of the 10th ACM International Conference on Multimedia, pp. 503-512, 2005.

Grecu, Andrei, "*Musical Instrument Separation*", Vienna University of Technology, Oct. 15, 2007, 3 pps.

Lathoud, et al., "*Sector-Baed Detection for Hands-Free Speech Enhancement in Cars*", eurasip Journal on Applied Signal Processing, vol. 2006, pp. 1-15.

Li, et al., "*Hemispherical Microphone Arrays for Sound Capture and Beamforming*", 2005 IEEE Workshop on Applications of Signal Processing to Audio and Acoustics, Oct. 16-19, 2005, pp. 106-109.

Moore, et al., "*Microphone Array Speech Recognition: Experiments on Overlapping Speech in Meetings*", Dalle Molle Institute for Perceptual Artificial Intelligence (IDIAP), ICASSP '03 IEEE International Conference 2003, V-497 to V-500.

Valin, et al., "*Enhanced Robot Audition Based on Microphon Array Source Separation with Post-Filter*", Intelligent Robots and Systems, 2004, Proceedings 2004 IEEE/RSJ International Conference, vol. 3, pp. 2123-2128.

Brandstein, et al.; "A practical methodology for speech source localization with microphone arrays"; Computer Speech and Language; 1997; II, pp. 91-126.

European Search Report dated Jan. 4, 2013 from EP 09809106.9, 11 pages.

Extended European Search Report dated Mar. 19, 2014 from European Application No. 13177034.9, 10 pages.

Australian Patent Examination Report No. 1 dated Jul. 10, 2014 from Australian Patent Application No. 2009287421, 3 pages.

* cited by examiner

MICROPHONE ARRAY SYSTEM AND METHOD FOR SOUND ACQUISITION

FIELD OF THE INVENTION

This invention relates to a microphone array system and a method for sound acquisition from a plurality of sound sources in a reception space. The invention extends to a computer program product including computer readable instructions, which when executed by a computer, cause the computer to perform the method.

The invention further relates to a method for sound source location, and a method for filtering beamformer signals in a microphone array system. The invention extends to a microphone array for use with a microphone array system.

This invention relates particularly but not exclusively to a microphone array system for use in speech acquisition from a plurality of users or speakers surrounding the microphone array in a reception space such as a room, e.g. seated around a table in the room. It will therefore be convenient to hereinafter describe the invention with reference to this example application. However it is to be clearly understood that the invention is capable of broader application.

BACKGROUND TO THE INVENTION

Microphone array systems are known and they enable spatial selectivity in the acquisition of acoustic signals, based on using principles of sound propagation and using signal processing techniques.

Table-top microphones are commonly used to acquire sounds such as speech from a group of users (speakers) seated around a table and having a conversation. The quality of the acquired sound with the microphone is adversely affected by sound propagation losses from the users to the microphone.

One way to reduce the losses in sound propagation is to use a microphone array system. The microphone array system includes, broadly, a plurality of microphone transducers that are arranged in a selected spatial arrangement relative to each other. The system also includes a microphone array interface for converting the microphone output signals into a different form suitable for processing by the computer. The system also includes a computing device such as a computer that receives and processes the microphone transducer output signals and a computer program that includes computer readable instructions, which when executed processes the microphone output signals. The computer, the computer readable instructions when executed, and the microphone array interface form structural and functional modules for the microphone array system.

Beamforming is a data processing technique used for processing the microphone transducers' output signals by the computer to favour sound reception from selected locations in a reception space around the microphone array. Beamforming techniques may be broadly classified as either data-independent (fixed) or data-dependent (adaptive) techniques.

Apart from sound acquisition enhancement from selected sound source locations in a reception space, a further advantage of microphone array systems is the ability to locate and track prominent sound sources in the reception space. Two common techniques of sound source location are known as the time difference of arrival (TDOA) method and the steered response power (SRP) method, and they can be used either alone or in combination.

Applicant believes that the development of prior microphone array systems for speech acquisition has mostly focused on applications for acquiring sound from a single user. Consequently microphone arrays in the form of linear or planar array geometries have been employed.

In scenarios having multiple sound sources, such as when a group of speakers are engaged in conversation, e.g. around a table, the sound source location or active speaker position in relation to the microphone array changes. In addition more than one speaker may speak at a given time, producing a significant amount of simultaneous speech from different speakers. In such an environment, the effective acquisition of sound requires beamforming to multiple locations in the reception space around the microphone array. This requires fast processing techniques to enable the sound source location and the beamforming techniques to reduce the risks of sound acquisition losses from any one of the potential sound sources.

Also, linear microphone array geometries that are known include limitations associated with the symmetry of their directivity patterns obtained from the microphone array. The problem of beam pattern symmetry is alleviated using microphone arrays having planar geometries. However its maximum directivity lies in its plane which limits its directivity in relation to sound source locations falling outside the plane. Such locations would for example be speakers seated around a table having their mouths elevated relative to the array plane.

Clearly therefore it would be advantageous if a contrivance or a method could be devised to at least ameliorate some of the shortcomings of prior microphone array systems as described above.

SUMMARY OF THE INVENTION

According to one aspect of the invention there is provided a microphone array system for sound acquisition from multiple sound sources in a reception space, the microphone array system including:

a microphone array interface for receiving microphone output signals from an microphone array that includes an array of microphone transducers that are spatially arranged relative to each other within the reception space;

a beamformer module operatively able to form beamformer signals associated with any one of a plurality of defined spatial reception sectors within the reception space surrounding the array of microphone transducers; and wherein the spatial reception sectors are defined by equiangular spatial reception sectors located about a vertical axis and a point on an apex of the sectors axially spaced apart from the vertical axis.

The array of microphone transducers may be spatially arranged relative to each other to form an N-fold rotational symmetrical microphone array about a vertical axis.

The beamformer module may include a set of defined beamformer weights that corresponds to a set of defined candidate sound source location points spaced apart within one of N rotationally symmetrical spatial reception sectors associated with the N-fold rotationally symmetry of the microphone array. The set of beamformer weights may be defined so as to be angularly displaceable about the vertical axis into association with any one of the N rotationally symmetrical spatial reception sectors.

In one embodiment, the microphone array may include a 6-fold rotational symmetry about the vertical axis defined by seven microphone transducers that are arranged on apexes of a hexagonal pyramid. That is, the microphone array may include six base microphone transducers that are arranged on apexes of a hexagon on a horizontal plane. The microphone array may further include one central microphone transducer that is axially spaced apart from the base microphone transducers on the vertical axis of the microphone array.

Such a microphone array, thus includes a 6-fold rotational symmetry about the vertical axis, to define microphone triads comprising two adjacent base microphones and a central microphone. Each microphone triad is associated with a spatial reception sector radiating outwardly from the microphone triad, thereby to define six equiangular spatial reception sectors about the vertical axis that form a 6-fold rotationally symmetrical reception space about the vertical axis.

The set of beamformer weights may be defined to correspond to a set of candidate sound source location points that are spaced apart from each other within one of the N spatial reception sectors.

In other words, the reception space around the microphone array may be conceptually divided into identical spatial reception sectors that are equiangularly spaced about the vertical axis. Each spatial reception sector may be conceptually divided into a grid of candidate sound source location points that are represented within the microphone indexes forming part of the beamformer weights. By displacing the microphone indexes angularly about the vertical axis, the same set of beamformer weights that are used for calculating a beamformer output signal in one, spatial reception sector can be used for calculating a beamformer output signal in any one of the other spatial reception sectors.

It will be appreciated that using a set of beamformer weights that is applicable by rotation to any sector, e.g. any other sector, is made possible by employing a rotational' symmetrical microphone array.

The microphone array interface may include a sample-and-hold arrangement for sampling the microphone output signals of the microphone transducers to form discrete time domain microphone output signals. Also, the microphone array interface may include a time-to-frequency conversion module for transforming the discrete time domain microphone output signals into corresponding discrete frequency domain microphone output signals having a. defined set of frequency bins.

The microphone array system may include a sound source location point index that is populated with a selected candidate sound source location point for each reception sector.

The beamformer module may be configured to compute, during each process cycle, a set of primary beamformer output signals that are associated with the directions of each selected candidate sound source location point in the sound source location point index.

The microphone array system may include a sound source location module for updating the sound source location point index during each processing cycle. The sound source location module may be configured to update only one of the selected candidate sound source location points in the sound source location point index during each processing cycle.

The sound source location module may be configured to determine the highest energy candidate sound source location point during each process cycle, the highest energy candidate sound source location point being determined by the direction in which the highest sound energy is received. The sound source location module may note the highest energy candidate sound source location point and its associated sector.

Further, the sound source location module may be configured to update the selected sound source location point of the reception sector within which the highest energy sound source location point is determined to reflect the highest energy sound source location point (as the sound source location point).

The sound source location module may be configured to determine the signal energies in the directions of a subset of sound source location points in each sector, the subset of sound source location points being localized around the selected sound source location point for each reception sector. The sound source location module may be configured to update the selected sound source location point of the reception sector within which the highest energy sound source location point is determined to correspond to the highest energy sound source location point.

The signal energy of each candidate sound source location point is calculated by using a secondary beamformer signal directed to the sound source location points of the subset of sound source location points, the secondary beamformer signal being calculated over a subset of frequency bins.

By way of explanation, the sound source location module performs a modified steered response power sound source location algorithm in that it computes the energy of the beamformer output signals over a subset of frequency bins.

Also, only a subset of sound source location points is used in each spatial reception sector during each processing cycle to perform sound source location. Further, only one sector point index entry of the sound source location point index is updated during a processing cycle. This reduces the processing time of the processing cycle that processes this information.

The microphone array system may include a post-filter module that is configured to define a pre-filter mask for each primary beamformer output signal.

The post-filter module may be configured to populate a frequency bin of the pre-filter mask for each primary beamformer signal with . a defined value if the value of the corresponding frequency bin of the primary beamformer signal is the highest amongst same frequency bins of all the beamformer output signals, otherwise to populate the frequency bin of the pre-filter mask with another defined value. The one defined value equals one and the other defined value equals zero.

The post-filter module may be configured to calculate an average value of each pre-filter mask for each primary beamformer signal, the average value being calculated over a selected subset of frequency bins, the selected subset of frequency bins corresponding to a selected frequency band. The selected frequency band may include frequencies corresponding to speech, for example the selected frequency band may include frequencies between 50 Hz to 8000 Hz.

The post-filter module may be configured to calculate a distribution value for each sector according to a selected distribution function, the distribution value for each sector being calculated as a function of the average value of the pre-filter mask for that sector. The distribution function may be a sigmoid function.

Further, the post-filter module may be configured to enter the distribution value for each primary beamformer output sector signal into frequency bin positions of the associated post-filter mask vector that correspond with frequency bin positions of the pre-filter mask vector having a value of one.

The post-filter module may be configured to determine the existing values of the post-filter masks at those frequency bins that correspond with those frequency bin positions of the pre-filter mask vector that have a zero value, and to apply to those values a defined de-weighting factor for attenuating those values during each cycle.

The selected weighting factor for each beamformer output signal may be determined as a function of the average value its pre-filter vector mask, and the selected weighting factor for each beamformer signal may be independently adjustable by a user via a user interface for effectively adjusting the sound output volume of each sector independently.

The microphone array system may include a mixer module for combining the filtered beamformer output signals to form a single frequency domain output signal. The microphone array system may also include a frequency-to-time converter module for converting the single frequency domain output signal to a time domain output signal.

The mixer module may be configured to compute a first noise masking signal that is a function of a selected one of the time domain microphone input signals and a first weighting factor, and to apply the generated white noise signal to the time domain output signal to form a first noise masked output signal.

The mixer module may be configured to compute a second noise masking signal that is a function of randomly generated values between selected values and a second selected weighting factor, and to apply the second noise masking signal to the first noise masked output signal to form a second noise masked output signal.

The microphone array system may also include a sound source association module for associating a stream of sounds that is detected within a spatial reception sector with a sound source label allocated to the spatial reception sector, and to store the stream of sounds and its label if it meets predetermined criteria.

The microphone array system may include a user interface for permitting a user to configure the sound source association module.

The sound source association module may include a state-machine module that includes four states namely an inactive state, a pre-active state, an active state, and a post-active state.

The state-machine may be configured to apply a criteria to a stream of sounds from a reception sector, and to promote the status of the state-machine to a higher status if successive sound signals exceed a threshold value, and to demote the status to a lower status if the successive sound signals are lower than the threshold value.

The criteria for each spatial reception sector may be a function of the average value of the pre-filter mask calculated for said sector.

Moreover, the state-machine may be configured to store the sound source signal when it remains in the active state or the post-active state and to ignore the signal when it remains in the inactive state or the pre-active state.

The sound source association module may include a name index having name index entries for the sectors, each name index entry being for logging a name of a user associated with a spatial reception sector.

The microphone array system may include a network interface for connecting remotely to another microphone array system over a data communication network.

The computer device may be selected from a personal computer and a embedded computer device.

According to a further aspect, the present invention also provides a method for processing microphone array output signals with a computer system, the method including:

receiving microphone output signals from an array of microphone transducers that are spatially arranged relative to each other within a reception space;

forming beamformer signals selectively associated with a direction of any one of a plurality of candidate sound source location points within any one of a plurality of defined spatial reception sectors of the reception space surrounding the array of microphone transducers; and defining the spatial reception sectors by equiangular spatial reception sectors located about a vertical axis and a point on an apex of the sectors axially spaced apart from the vertical axis.

The method may include receiving microphone output signals from microphone transducers that are spatially arranged relative to each other to form an N-fold microphone array that is rotationally symmetrical about a vertical axis.

The method may include defining a set of beamformer weights that correspond to a set of candidate sound source location points spaced apart within one of N rotationally symmetrical spatial reception sectors associated with the N-fold rotationally symmetry of the microphone array, and displacing the set of beamformer weights angularly about the vertical axis into association with any one of the N rotationally symmetrical spatial reception sectors.

The method may include defining a set of beamformer weights that corresponds to a set of candidate sound source location points that are spaced apart within one of the N spatial reception sectors.

The method may include sampling the microphone output signals of the microphone transducers to form discrete time domain microphone output signals, and transforming the discrete time domain microphone output signals into corresponding discrete frequency domain microphone signals having a set of frequency bins.

The method may include defining a sound source location point index that includes a selected candidate sound source location point for each reception sector, and forming primary beamformer output sector signals associated with the direction of each selected candidate sound source location point during a process cycle, each beamformer output signal includes a set of frequency bins.

The method may include updating the sound source location point index for each reception sector during each processing cycle.

The method may include updating at least one of the selected candidate sound source location points of the sound source location point index during each processing cycle. The method may include determining the candidate sound source location point with the highest energy, corresponding to the direction in which the highest sound energy is received. The method may include noting the highest energy candidate sound source location point and its associated sector, and updating the selected sound source location point of the reception sector within which the highest energy sound source location point is determined to correspond to the highest energy sound source location point.

The method may include determining the signal energies in the directions of a subset of sound source location points in each sector localized around the selected sound source location point, for each reception sector, and updating the selected sound source location point of the reception sector within which the highest energy sound source location point is determined to correspond the highest energy sound source location point.

The method may include calculating the signal energy of each candidate sound source location point of the sub set of sound source location point over a subset of frequency bins.

The method may include defining a pre-filter mask for each primary beamformer output sector signal, and defining a post-filter mask for each primary beamformer output sector signal based on its associated pre-filter mask.

The method may include populating a frequency bin of the pre-filter mask for each primary beamformer signal with a defined value if the value of the corresponding frequency bin of the primary beamformer signal is the highest amongst same frequency bins of all the primary beamformer signals, and otherwise populating the frequency bin of the pre-filter mask with another defined value. For example, one value may be equal to one, and the other value may be equal to zero.

The method may include defining the post-filter mask vectors further includes determining an average value of the entries of each pre-filter mask respectively over a sub-set of frequency bins that correspond to a selected frequency band. The selected frequency band may include frequencies associated with speech.

The method may include defining a distribution value for each sector according to a selected distribution function as a function of the average value of the sector. The distribution function may be a sigmoid function.

The method may include populating each sector's post-filter mask vector with the distribution value of the sector at those frequency bins corresponding to those frequency bins of its pre-filter mask vector having a value of one, and multiplying the remaining frequency bins with a de-weighting factor for attenuating the remaining frequency bins during each cycle.

The method may include applying the post-filter masks to their respective primary beamformer output signals to form filtered beamformer output signals.

The method may include applying selected weighting factors to the beamformer output signals respectively. The selected weighting factor for each beamformer output signal may be determined as a function of the calculated average value of its pre-filter vector mask.

The selected weighting factor for each beamformer signal may be independently adjustable by a user for effectively adjusting the sound output volume of each sector independently.

The method may include combining the filtered beamformer output signals with a mixer module to form a single frequency domain output signal, and converting the single frequency domain output signal to a time domain output signal.

The method may include computing a first noise masking signal that is a function of a selected one of the time domain microphone input signals and a first weighting factor, and applying the generated first noise masking signal to the time domain output signal to form a first noise masked output signal.

Also, the method may include computing a second noise masking signal that is a function of randomly generated values between selected values and a second selected weighting factor, and applying the second noise masking signal to the first noise masked output signal to form a second noise masked output signal.

The method may include monitoring a stream of sounds from each sector, validating the stream of sounds from each sector if it meets predetermined criteria, and storing the stream of sounds if the predetermined criteria are met.

Validating a stream of sounds from a sector may include defining criteria in a state-machine module that includes four states namely an inactive state, a pre-active state, an active state, and a post-active state, and storing the stream of sounds when the state-machine is in the active state and post-active states and ignoring the sounds when it is in the inactive or pre-active state. The criteria for each sector in the state machine may be defined as a function of the calculated average value of its pre-filter mask.

The method may include receiving control commands for the microphone array from a user via a user interface. Also the method may include receiving sound source labels with the user interface, each sound source label being-associated with a sector, and storing valid streams of sounds from each sector and its sound source label in a sound record for later retrieval and identification of the sounds. The sound source labels may include the names of users in the spatial reception sectors.

Thus, a sound recording is created for each sound source in each spatial reception sector which is retrievable at a later stage to replay the sounds that were recorded, and the state machine module is employed selectively to record useful streams of sound and to avoid recording sporadic noise from the sectors.

Also, the method may include establishing remote data communication over a data communication network with the microphone array. One microphone array system may therefore communicate with another microphone array system over a data communication network for remote conferencing.

The invention further provides a computer product that includes computer readable instructions, which when executed by a computer, causes the computer to perform the method as defined above.

The invention yet further provides a microphone array that includes:

seven microphone transducers that are arranged on apexes of a hexagonal pyramid, so that the microphone array includes a 6-fold rotational symmetry about the vertical axis.

That is, the microphone array may include six base microphone transducers that are arranged on apexes of a hexagon on a horizontal plane, and one central microphone transducer that is axially spaced apart from the base microphone transducers on the vertical axis of the microphone array.

According to yet another aspect of the invention in a microphone array system for sound acquisition from multiple sound sources in a reception space, which microphone array system includes a microphone array interface for receiving microphone output signals from an array of microphone transducers that are spatially arranged relative to each other within the reception space, and includes a beamformer module operatively able to form beamformer signals associated with a direction to anyone of a plurality of defined candidate sound source location points within any one of a plurality of defined spatial reception sectors of the reception space surrounding the array of microphone transducers, there is provided a method for sound source location within in each one of the reception sectors, which method includes:

defining a sound source location point index comprising one selected sound source location point for each of a plurality of defined spatial reception sectors surrounding the microphone array; and updating only one of the selected candidate sound source location points in the sound source location point index during each processing cycle.

The method may include determining during each process cycle the highest energy candidate sound source location point which corresponds to the direction in which the highest sound energy is received; and noting the highest energy candidate sound source location point and its associated sector.

The method may include updating the selected sound source location point of the reception sector within which the highest energy sound source location point is determined to correspond to the highest energy sound source location point.

The method may include determining the signal energies respectively in the directions of a subset of sound source location points in each sector localized around the selected sound source location point for each reception sector, and updating the selected sound source location point of the reception sector within which the highest energy sound source location point is determined to correspond to the highest energy sound source location point.

The method may include calculating the signal energy of each candidate sound source location point using a secondary beamformer signal directed to the sound source location points of the subset of sound source location points, the secondary beamformer signal being calculated over a subset of frequency bins.

According to even a further aspect of the invention there is provided a method for filtering discrete signals, each discrete signal having a set of frequency bins, which method includes:

determining an indicator value for, each discrete signal, which indicator value is a function of the values of selected frequency bins of the discrete signal having the highest value compared to same frequency bins of the other discrete signals;

determining a distribution value for each discrete signal that is a function of the indicator value;

populating for each discrete signal a post-filter mask vector that includes values at the selected frequency bins that are a function of its distribution value; and applying the post-filter masks to their associated discrete signals.

Determining an indicator value may include defining a pre-filter mask for each discrete signal by populating a frequency bin of the pre-filter mask for each discrete signal with a defined value if the value of the corresponding frequency bin of said discrete signal is the highest amongst same frequency bins of all the discrete signals, otherwise to populate the frequency bin of the pre-filter mask with another defined value.

Each indicator value may equal an average value of each pre-filter mask for each primary beamformer signal, the average value being calculated over a selected subset of frequency bins, the selected subset of frequency bins corresponding to a selected frequency band associated with the type of sound sources that are to be acquired by the microphone array system.

The method may include defining the one value equal to one and the other value equal to zero, and defining the selected frequency band to correspond to selected frequencies of human speech.

Determining a distribution value for each discrete signal may include calculating for each discrete signal a distribution value according to a selected distribution function, which distribution value for each sector is calculated as a function of the average value of the pre-filter mask for said discrete sector. For example, the distribution function may be a sigmoid function.

The method may include entering the distribution value for each discrete signal into frequency bin positions of the associated post-filter mask vector that correspond with frequency bin positions of the pre-filter mask vector having a value of one.

The method may include populating those frequency bins of the post-filter mask vector that correspond with those frequency bin positions of the pre-filter mask vector that have a zero value with a value corresponding to its value from a previous process cycle attenuated by a defined weighting factor.

In one embodiment of the invention, the discrete signals may be beamformer signals having frequency bins.

DETAILED DESCRIPTION OF THE PREFERRED EMBODIMENTS

A microphone array system, in accordance with this invention, may manifest itself in a variety of forms. It will be convenient to hereinafter describe an embodiment of the invention in detail with reference to the accompanying drawings. The purpose of providing this detailed description is to instruct persons having an interest in the subject matter of the invention how to carry the invention into practical effect. However it is to be clearly understood that the specific nature of this detailed description does not supersede the generality of the preceding broad description. In the drawings.

Figure 1:
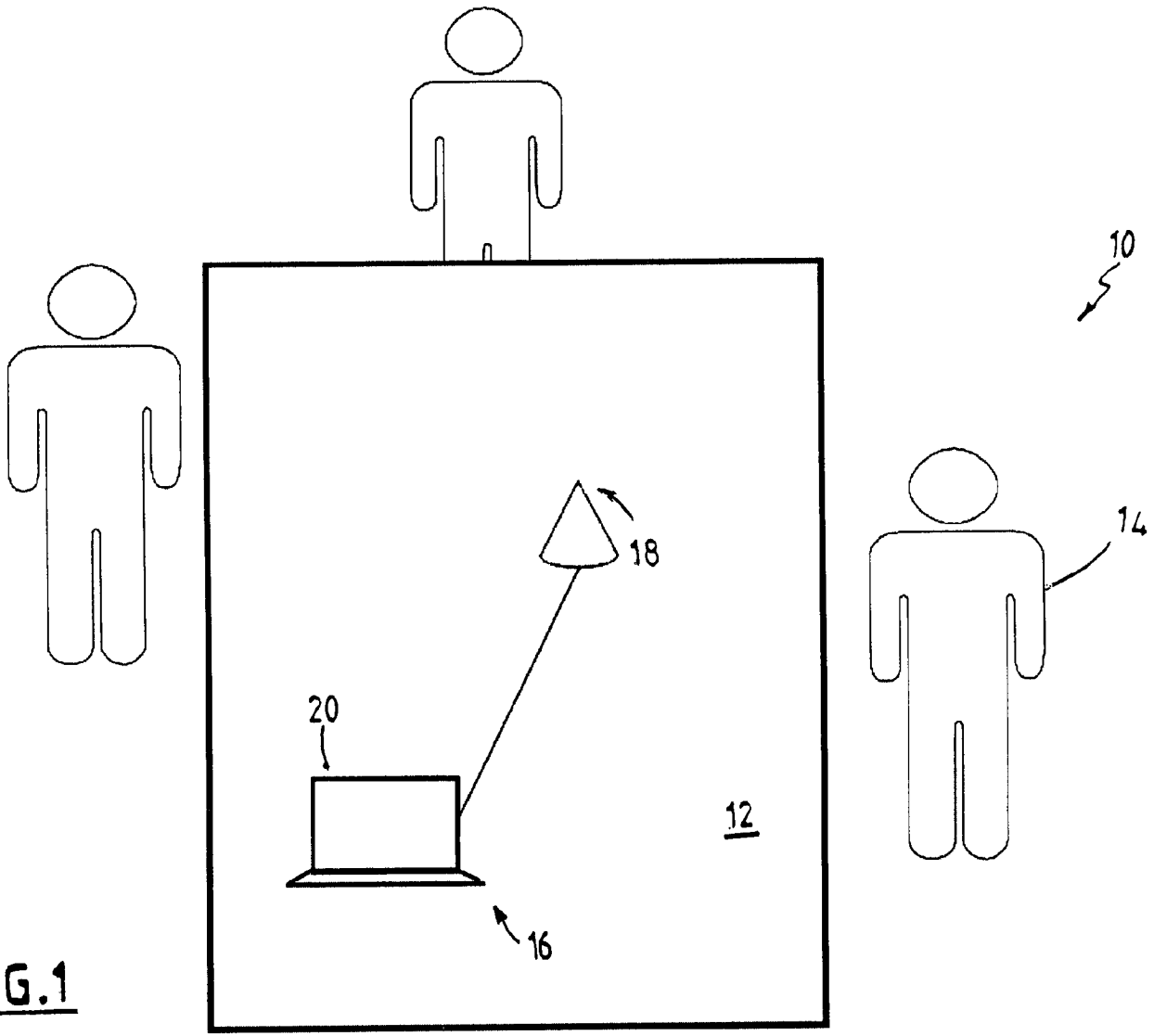
FIG. 1 shows schematically a meeting room in which users meet around a table, and a microphone array system, in accordance with the invention, in use, with a microphone array mounted on the table top.

FIG. 1 shows schematically a meeting room having a table 12 and a plurality of users 14 arranged around the table. Reference numeral 16 generally indicates a microphone array system, in accordance with the invention.

The microphone array system 16 includes a microphone array 18 mounted on the table-top 12 and a computer system 20 for receiving and processing output signals from the microphone array 18. The computer system is in the form of a personal computer (PC) 20 for receiving and processing the microphone output signals from the microphone array 18.

In another embodiment (not shown) of the invention, the microphone array system can be a stand alone device for example it can include the microphone array and an embedded microprocessor device.

Figure 2:
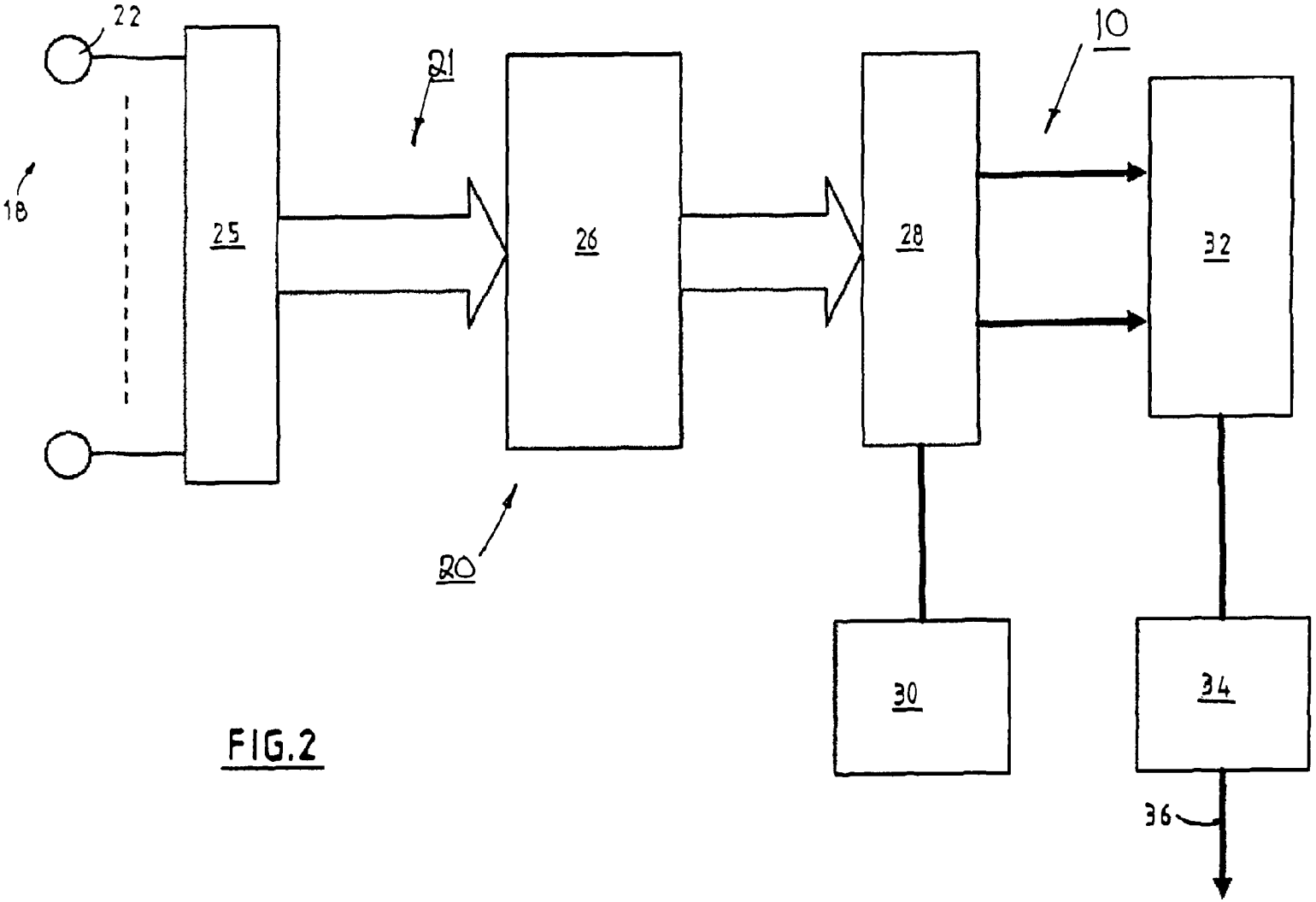
FIG. 2 shows a functional block diagram of the microphone array system in FIG. 1.

FIG. 2 shows a functional block diagram of the microphone array system 16. The microphone array system 16 is for sound acquisition in a reception space, such as the meeting room, from a plurality of potential sound sources namely the users 14. The microphone array system 16 includes the microphone array 18 that has a plurality of microphone transducers 22. The microphone transducers 22 (see FIG. 3) are arranged relative to each other to form an N-fold rotationally symmetrical microphone array about a vertical axis 24. The significance of the N-fold rotational symmetry is explained in more detail below.

The microphone array system 16 also includes a microphone array interface, generally indicated by reference numeral 21. The microphone array interface includes a sample-and-hold arrangement 25 for sampling the microphone output signals of the microphone transducers 22 to form discrete time domain microphone output signals, and for holding the discrete time domain signals in a sample buffer. Typically, the sample-and-hold arrangement 25 includes an analogue-to-digital converter module that can be provided by the PC or onboard the microphone array 18, and the sample buffer is provided by memory of the PC.

Further, the microphone array interface 21 includes a time-to-frequency conversion module 26 for transforming the discrete time domain microphone output signals into corresponding discrete frequency domain microphone signals having a defined set of frequency bins.

A beamformer module 28 forms part of the microphone array system 16 for receiving the discrete frequency domain microphone output signals. The beamformer 28 includes a set of defined beamformer weights corresponding to a set of candidate source location points spaced apart within one of N spatial reception sectors in the reception space surrounding the microphone array, the N spatial reception sectors corresponding to the N-fold rotational symmetry of the microphone array 18.

Figure 3B:
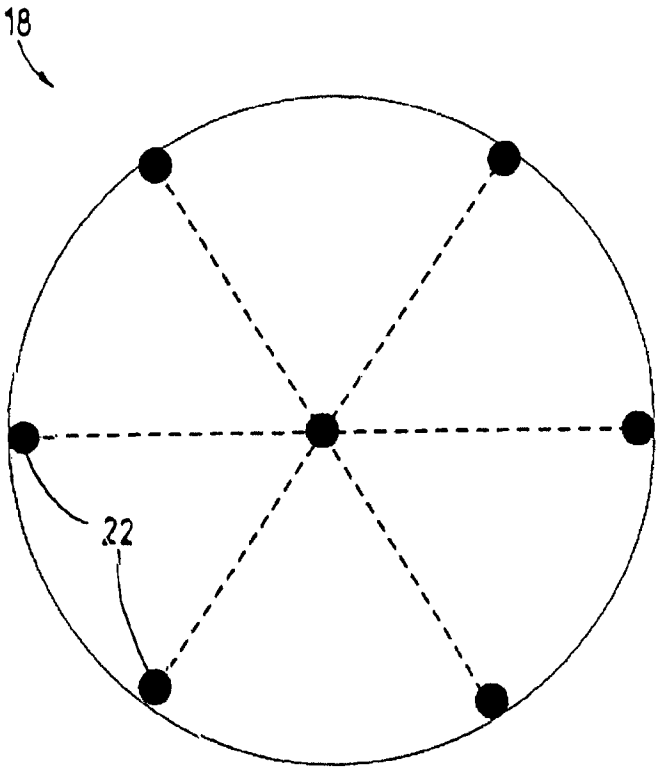
FIGS. 3A and 3B show schematically a three-dimensional view and a top view respectively of an arrangement of microphone transducers forming part of the microphone array in accordance with one embodiment of the invention.
Figure 3A:
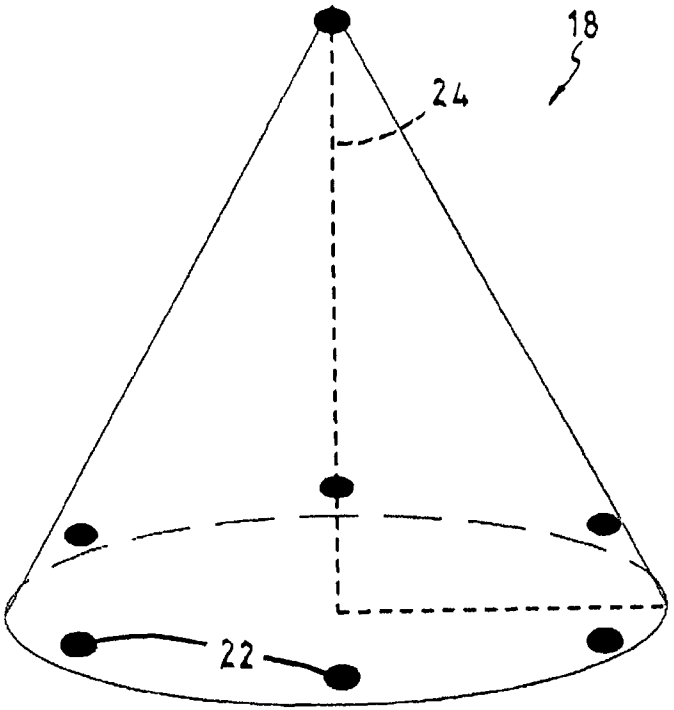
Figure 4:
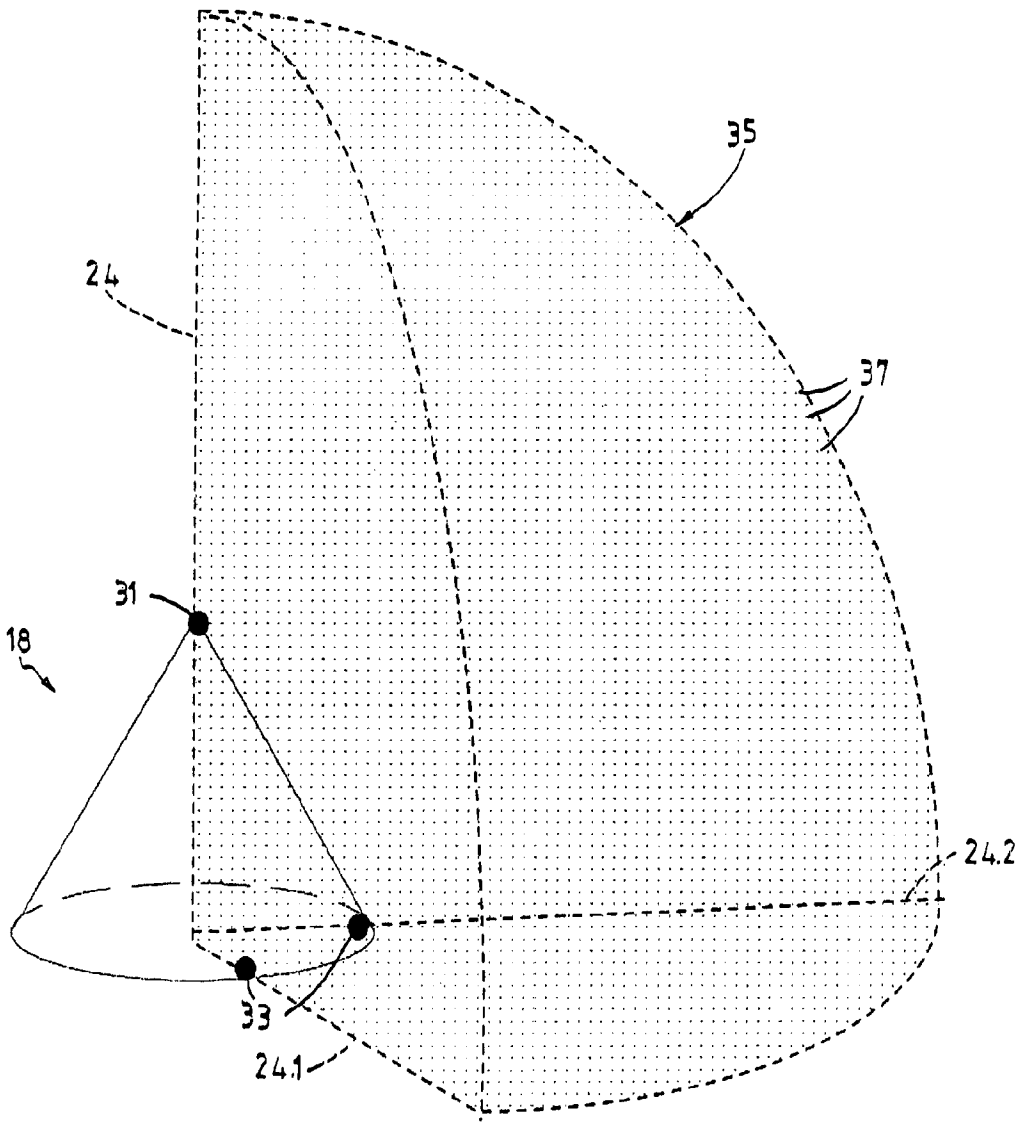
FIG. 4 shows schematically a spatial reception sector defined within a reception space surrounding the microphone array in FIG. 3.
Figure 5:
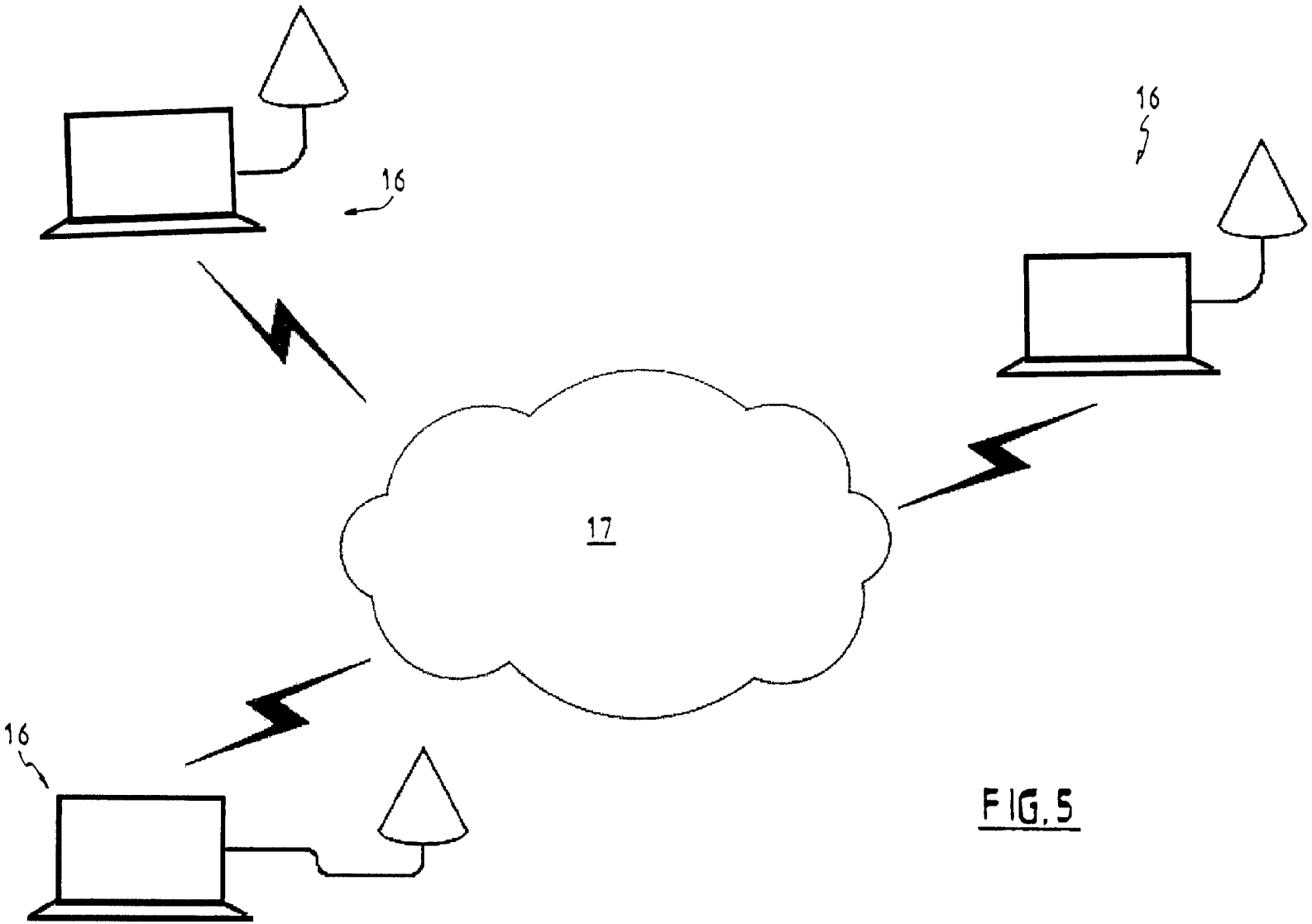
FIG. 5 shows schematically a plurality of microphone array systems that are connected to each other over a data communication network.

The microphone array 18, in this example, includes seven microphone transducers 22 that are arranged on apexes of a hexagonal pyramid (see FIG. 3). Thus, six microphone transducers 33 are arranged on apexes of a hexagon on a horizontal plane to form a horizontal base for the microphone array, and one central microphone transducer is axially spaced apart from the horizontal base on the central vertically extending axis 24 of the microphone array.

Such microphone array, thus, includes a 6-fold rotational symmetry about the vertical axis 24, so that each microphone triad is defined by two adjacent base microphones 33 and the central microphone 31, and that is associated with a spatial reception sector 35 radiating outwardly from the microphone triad, so that six equiangular spatial reception sectors are defined about the vertical axis 24 that form an N-fold rotationally symmetrical reception space about the vertical axis 24.

The spatial arrangement of the microphone transducers 22 thus also lies on a conceptual cone shaped space, with the base transducers on a pitch circle forming the base of the cone and the central microphone 31 at an apex of the cone. In the illustrated embodiment, shown in FIG. 3, the circular base of the cone has a radius of 3.5 cm, although in general this may be up to 15 cm. The height of the cone is 7 cm in the illustrated embodiment.

In this example, the microphone transducers 22 are omni-directional-type transducers. The microphone array 18 can include additional microphone transducers (not shown). For example at least two microphone transducers can be arranged on a pitch circle that coincides with a transverse circle formed by the outline of the cone shaped space intermediate the base and the apex of the cone.

The microphone array can also include an embedded visual display (not shown), such as a series of LEDs (light emitting diodes) located between the base and apex to provide visual signals to the users of the microphone array system 16.

Moreover, the microphone array can include a fixed steerable, or a panoramic, video camera (not shown), located on a surface of the cone between the base and apex, or at either extremity. The microphone array may have more than one camera. For example the microphone array may have cameras on two or more facets of the hexagonal pyramid. In one form separate cameras may be located on alternate facets of the hexagonal pyramid. In another form separate cameras may be located on each facet of the hexagonal pyramid.

The microphone array interface for the computer, such as the PC 20, can include any conventional interface technology, for example USB, Bluetooth, Wifi, or the like to communicate with the PC.

The reception space around the microphone array 18 is conceptually divided into identical spatial reception sectors 35 that are equiangularly spaced about the vertical axis, and each spatial reception sector 35 is conceptually divided into a grid of candidate sound source location points 37 that are represented within the beamformer weights.

The set of beamformer weights is used to calculate beamformer output signals corresponding to the set of candidate source location points 37 that are spaced apart within one of the N spatial reception sectors 35. The candidate source location points are in the form of a grid of location points. Thus, a beamformer output signal is calculated for any one of the candidate sound source location points 37 in the spatial reception sector 35. The microphone indexes are angularly displaceable about the vertical axis 24 selectively into association with any one of the other N spatial reception sectors, thereby to use only one set of defined beamformer weights to calculate beamformer signals associated with any one of the spatial reception sectors.

By displacing the microphone indexes arithmetically angularly during a process cycle, the same set of beamformer weights that are used for calculating a beamformer output signal in one spatial reception sector can be used for calculating a beamformer output signal in any one of the other spatial reception sectors. Using a set of beamformer weights that is applicable by rotation to any other sector is possible by employing a discrete rotational symmetrical microphone array.

Using a conical microphone array arrangement as illustrated, each spatial reception sector 35 is defined by equally sized wedges of the hemispherical space extending from the base centre of the microphone array device 18. Each wedge is defined between three radial axes 24, 24.1, and 24.2 that extend through the lines defined by a given triad of microphone transducers of the microphone array, wherein the triad consists of the elevated centre microphone transducer 31 and two adjacent base microphone transducers 33. The radial range of the wedge-shaped spatial reception sectors 35 is configurable, and will typically be of the order of several metres. In another embodiment, the spatial reception sectors can be defined between two radial axis extending from intermediate adjacent pairs of base microphone transducers.

The microphone array system 16 also includes a sound source location module 30 for determining a selected candidate sound source location point for each sector in which direction a primary beamformer output signal for each sector is to be calculated, during each processing cycle.

Broadly, the sound source location module 30 includes a sound source location point index comprising a selected sound source location point for each spatial reception sector 35. The sound source location point. index, in this example, includes six selected sound source location points, one for each sector.

Thus the beamformer module is configured to calculate during each process cycle, primary beamformer output signals associated with the selected sound source location points, so as to form a set of primary beamformer output signals. It will be appreciated that each primary beamformer output signal is in the form of a beamformer output signal vector having a defined set of frequency bins.

The distribution and number of sound source location points 37 defined within each sector 35 is based on considerations of computational complexity and spatial resolution. For illustrative purposes the spatial reception sector 35 is defined between the azimuth, elevation and radial range of a reception sector and is uniformly divided.

A vector of frequency domain filter-sum beamformer weights, $w_k(f)=\{w_{ik}(f)\}$ is defined between each microphone element i in the array and each sound source location point 26 (k). The beamformer weights are calculated according to any one of a variety of methods familiar to those skilled in the art.

The methods include for example delay-sum or superdirective beamforming. These beamformer weights only need to be pre-calculated once for the microphone array configuration, as they do not require updating during each process cycle.

The beamformer weights that have been calculated for the sound source location points within one spatial reception sector can be used to obtain sound source location points selectively for any one of the other spatial reception sector, due to the symmetry of the microphone array 18 about the vertical axis 24. This is done by simply applying a rotation to the microphone indices of the beamformer weights, thereby increasing memory efficiency in the computer.

The sound source location module 30 is configured to update the sound source location point index that is used for calculating the primary beamformer output signals during each processing cycle. In this embodiment, the sound source location module 30 is configured to update only one of the selected sound source location points during each processing cycle. To this end, the sound source location module 30, in accordance with the invention, is configured to calculate primary beamformer output signals over a subset of frequency bins for a subset of candidate source location points in each spatial reception sector, as is explained in more detail below.

Using the defined beamformer weights, the sound source location module 30 determines the signal energy at each sound source location point localised around each selected sound source location point k within each spatial reception sector s, as:

$$E_s(k) = \sum_{f=f_1}^{f_2} |w_k^H(f) \times x(f)|$$

where x(f) is the frequency domain microphone output signals from each microphone, $(\ )^H$ denotes the complex conjugate transpose, and $f_1$ and $f_2$ define the subset of frequencies of interest, as described below. Note that to benefit from memory efficiencies as described above, the beamformer weights are appropriately rotated to the correct reception sector orientation as required.

Initially, the selected sound source location points for the spatial reception sectors are thus determined as the one with maximum energy, as:

$$k'_s = \underset{k}{\operatorname{argmax}} E(k)$$

Three deviations from this standard SRP grid search are implemented to improve computational efficiency and consistency of the estimated locations, namely:

First, in the above argmax step, the signal energy is determined in the directions of a subset of sound source location points localised around the selected candidate sound source location point, in other words within $\Delta_k$ steps from the selected sound source location point in selected directions. This reduces the search space in each spatial reception sector during the process cycle to $(1+2\Delta_k)^3$ points instead of the full $N_k$-sound source location points. Typically, $\Delta_k$ can be 1 or 2, yielding a search space that includes 9 or 125 points within each spatial reception sector.

Secondly, a secondary beamformer output signal is used during the search. That is, beamformer output signals are calculated using a selected sub set of frequencies $f_1 \leq f \leq f_2$ within a selected subset of frequencies that corresponds to a frequency band of sounds of interest within the reception space. For example, the subset of frequencies can include the typical range of the frequencies within the speech spectrum if speech is to be acquired. Most energy in the speech spectrum falls in a particular range of frequencies. For instance, telephone speech is typically band-limited to frequencies between 300-3200 Hertz without significant loss of intelligibility. A further consideration is that sound source localisation techniques are more accurate (i.e. have greater spatial resolution) at higher frequencies. A significant step that reduces computation, improves accuracy of estimates, and increases the sensitivity to speech over other sound sources, is therefore to restrict the SRP calculation to a particular frequency band of frequencies of interest. The exact frequency range can be designed to trade-off these concerns. However for speech acquisition this will typically occupy a subset of frequencies between 50 Hz to 8000 Hertz.

Thirdly, only one selected sound source location point within the sound source location point index is updated during each process cycle. The selected sound source location point that is updated is chosen as that with the greatest SRP determined during each process cycle, i.e:

$$s_t = \underset{s}{\operatorname{argmax}} E_s(k'_s)$$

in which the selected sound source location point is updated as $k_{s_t} = k^*_{s_i}$. This improves the robustness and stability of estimates over time, as typically the higher energy estimates will be more accurate. Due to the non-stationary nature of the speech signal, the spatial reception sector that includes the highest energy sound source location point will vary from one process cycle to the next.

Once the source location point index is updated, then primary beamformer output signals are calculated in the directions of the updated selected sound source location points as:

$$y_s(f) = w_{k_s}^H x(f)$$

Note that to benefit from memory efficiencies as above, the beamformer weights are appropriately rotated about the vertical axis into each spatial reception sector successively.

Further, the microphone-array system 16 in this embodiment of the invention also includes a post-filter module 32 for filtering discrete signals having a set of defined frequency bins, such as the primary beamformer signals that each has a set of frequency bins. The post-filter module 32 is configured to define a pre-filter mask for each primary beamformer output signal, and to use the pre-filter mask to define a post-filter mask for each primary beamformer output signal.

The post-filter module is configured to compare the values of the entries in associated frequency bins of the beamformer output sector signals, and to allocate a value of 1 to an associated entry of the pre-filter mask vector for the beamformer output signal that has the highest (maximum) value at said frequency bin, and to allocate a value of 0 to every entry in the pre-filter mask that is not the maximum value of the frequency bins when compared to associated frequency bins of the beamformer vectors.

Thus, a pre-filter mask vector comprises entries of either the value one or the value zero in each frequency bin, in which a value of one indicates that for that frequency bin the beamformer signal had the maximum value amongst associated frequency bins of all the beamformer signals.

The post-filter module is also configured to calculate a post-filter mask vector for each beamformer output sector signal by determining an average entry value over a defined subset of frequency bins of each pre-filter mask vector. The subset of frequency bins may be selected for a range of speech frequencies, for example between 300 Hz and 3200 Hz. Thus, the average entry value that is obtained from each pre-filter mask vector provides a measure of speech activity in each sector during each processing cycle.

Further, the post-filter module is configured to calculate a distribution value that is associated with each average value entry according to a selected distribution function. The distribution function is described below.

The post-filter module is configured to enter the determined distribution values for each beamformer output signal into a frequency bin position of the post-filter mask vector that corresponds with frequency bin position having values of 1 in the associated frequency bins of the pre-filter mask vector.

The post-filter module is also configured to determine the existing entry values of the post-filter vector at those frequency bins that correspond with the frequency bin position of the pre-filter mask vectors that have a zero value, and to replace the existing entry values with the same value scaled by a de-weighting factor for attenuating those frequency bins.

The Applicant is aware that the spectrum of the additive combination of two speech signals can be well approximated by taking the maximum of the two individual spectra in each frequency bin, at each process cycle. This is essentially due to the sparse and varying nature of speech energy across frequency and time, which makes it highly unlikely that two concurrent speech signals will carry significant energy in the same frequency bin at the same time.

In other words, a masking pre-filter $h_s(f)$ is thus calculated in each sector s=1:S according to:

$$h_s(f) = \begin{cases} 1 & \text{if } s = \text{argmax}_{s'} |y_{s'}(f)|^2, s' = 1:S \\ 0 & \text{otherwise} \end{cases}$$

We note that when only one person is actively speaking, the other beamformer output signals from the other sectors will essentially be providing an estimate of the background noise level, and so the post-filter also functions to reduce background noise. This pre-filter mask also has the benefit of low computational cost compared to other formulations which require the calculation of channel auto- and cross-spectral densities.

While the above pre-filter mask has been shown experimentally to reduce cross-talk between beamformer outputs, and lead to improved performance in speech recognition applications, the natural sound of the speech can be degraded by the highly non-stationary nature of the pre-filter transfer function, that is caused by the binary choice between a zero or unity weight.

To keep the benefits of the masking pre-filter whilst also retaining the natural intelligibility of the output for a human listener, a post-filter is derived as follows. First, an indicator of speech activity in each spatial reception sector s is defined as:

$$p_s(\text{speech}) = \frac{1}{1 - \alpha e^{(r_s - \beta)}}$$

where $$r_s = \frac{1}{f_2 - f_1} \sum_{f=fr_1}^{f_2} h_s(f)$$

with $h_s(f)$ as defined above. Heuristics or empirical analysis may be used to set the parameters α and β in this equation. For example, α can be set to equal 1 and β can be set to be proportional to 1/S, for example 2/S.

Having defined the indicator of active speech in each sector for a given time step, a smoothed masking post-filter is defined as:

$$g_s(f) = \begin{cases} p_s(\text{speech}) & \text{if } h_s(f) = 1 \\ \gamma g_s'(f) & \text{otherwise} \end{cases}$$

where $g^*_s$ represents the post-filter weight at the previous time step, and γ is a configurable parameter less than unity that controls the rate at which each weight decays after speech activity. In the illustrative embodiment, a value of γ=0.75 is used. A filtered beamformer output signals for each spatial reception sector is obtained as:

$$z_s(f) = g_s(f) y_s(f)$$

The microphone array system 16 also includes a mixer module 34 for mixing or combining the filtered beamformer output signals to form a single frequency domain output signal 36. The mixer module 34 is configured to multiply each element of each filtered beamformer output signal with a weighting factor, which weighting factor for each filtered beamformer output signal is selected as a function of its associated calculated average value.

The mixer module 34 includes a frequency-to-time converter module for converting the single frequency domain output signal to a time domain output signal.

More specifically, for real-time applications involving human listeners, it is necessary to provide a single output audio channel containing sound from all sectors.

Once the post-filtered output signal $z_s(f)$ for each sector has been calculated, a single audio output channel for the device is formed as:

$$z(f) = \sum_{s=1}^{S} \delta_s z_s(f)$$

where $\delta_s$ is a sector-dependent gain or weighting factor that may be adjusted directly by a user, effectively forming a sound output volume control for each sector. The above output speech stream can contain a low level distortion relative to the input speech due to the non-linear post-filter stage.

In order to mask these distortions in the output signal, an attenuated version of the centre microphone transducer output signal is applied to the single output signal. The centre microphone signal is weighted with a first weighting factor, and applied to the output signal to form a first noise masked output signal.

Thereafter, a low level of a generated white noise signal also including a second weighting factor is applied to the first noise masked output signal to form a second noise masked output signal.

The weighting of the centre microphone transducer signal is set heuristically as a proportion of the expected output noise level of the beamformer (i.e. in inverse proportion to the number of microphones).

The variance for the masking white noise can also be set heuristically as a proportion of the background noise level estimated during non-speech frames.

A computer program product having a set of computer readable instructions, when executed by a computer system, performs the method of the invention. The method is described in more detail with reference to pseudo-code snippets and FIGS. 6 to 9 that show basic flow diagrams of part of the pseudo-source code.

Figure 6:
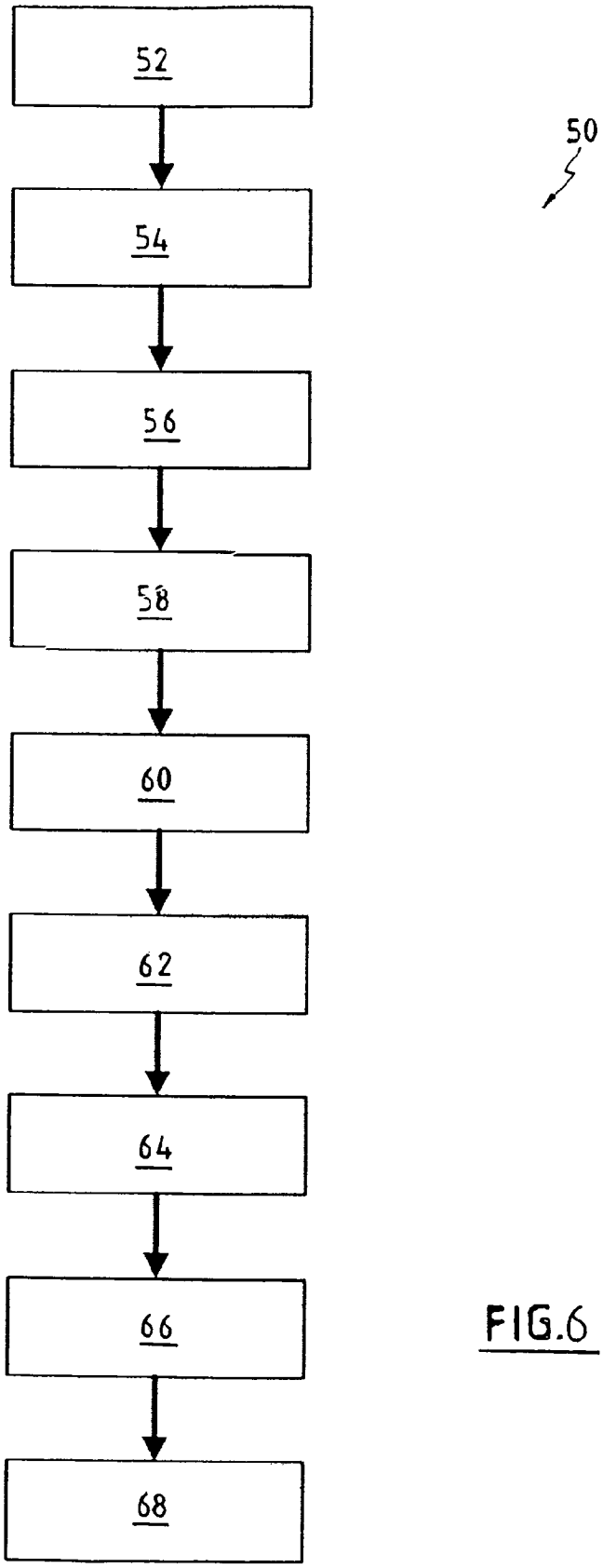
FIG. 6 shows a basic flow diagram of process steps forming part of a method of acquiring sound from a plurality of sound source locations, in accordance with one embodiment of the invention.

FIG. 6 shows a flow diagram 50 of a basic overview of a process cycle for acquiring sound from the reception space and for producing a single channel output signal. For purposes of illustration, a few variables for the computer program are defined as follows:

L=length of frame (number of samples)
Nm 32 number of input channels (microphones)
Ns=number of sectors
Np=number of points within sector localisation grid
Nf=number of frequency bins in the FFT
x=[ Nm * L ] matrix of real-valued inputs in time domain
W=[ Np * Nm * Nf ] matrix of complex frequency-domain beamformer filter weights for each grid point
P=[ Ns * 1 ] grid point indices
delta=[ Ns * 1 ] vector of gain factors set as a function of sector probability e.g. delta[s]=fn( pr[ s ] )
epsilon=desired level for centre microphone signal in output mixture, set e.g. proportional to 1/Ns
sigma=level of white noise added to output mix, set e.g. proportional to estimated background noise level At 52, the discrete time domain microphone output signals are received from the microphone transducers 22 of the microphone array 18. The time domain microphone output signals are converted, at 54, into discrete frequency domain microphone signals by the time-to-frequency converter module 26. At 56, the location module 30 updates the sound source location point index, and the beamformer module 28 calculates, at 58, primary beamformer output signals for corresponding to the selected sound source location points of the sound source location point index.

The post-filter module 32 calculates, at 60, a post-filter mask for each primary beamformer output signal for each spatial reception sector, and the post-filter masks are applied, at 62, to the primary beamformer output signals to form the filtered beamformer output signals.

The mixer module 34 combines, at 64, the filtered beamformer output signals to form a single discrete frequency domain output signal. At 66, the discrete frequency domain output signal is converted to a discrete time domain output signal which is masked, at 68, with a noise masking signal.

At 52, the time domain microphone signals x are captured and stored by the PC.

The time domain microphone signals x are converted, at 54, to frequency domain microphone signals X using Fast Fourier Transform (FFT) i.e X=fft(x), in which X is a Nm*Nf matrix of complex-valued frequency domain spectral coefficients.

Figure 7:
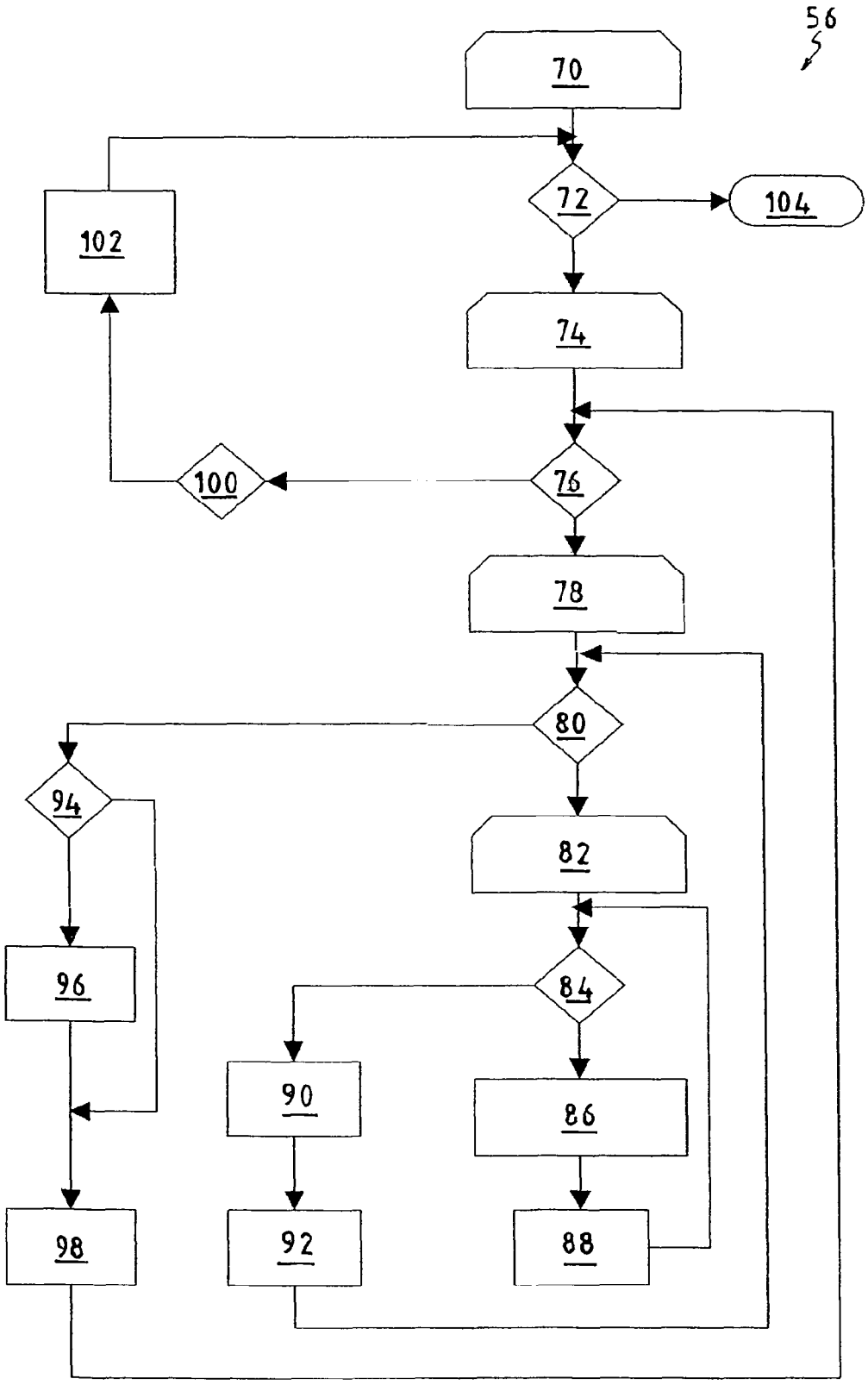
FIG. 7 shows a flow diagram of a method for sound source location steps forming part of the process steps in FIG. 6.

At, 56 the sound source location point index p is updated (see FIG. 7). A variable Energy_MaxAllSectors is set to 0; and a for-loop, at 70, is executed for each sector s with as loop counter, at 72. Within this loop a for-loop is executed, at 74, for each grid point p with p as loop counter, at 76, and within this loop a for-loop is executed, at 78, with each frequency in the subset of frequencies bins f1 to f2, with f as loop counter at 80. It is important to note that a subset of the frequency bins f1 to f2 is used in accordance with the invention.

Within the frequency loop, another for-loop is executed, at 82, for each microphone m with m as the loop counter, at 84. Within the m-loop a beamforming calculation is performed, at 86, as Y[s, f]=Y[s, f]+(X[m, f]*W[p, m, f]), and the loop counter m is updated, at 88.

```
Energy_MaxAllSectors = 0
    for each sector s
        Energy_MaxAllPoints = 0
        for each grid point p
            Energy_ThisPoint = 0
            for each frequency f between f1 and f2 (ie a subset of all
            Nf)
                Y[ s, f ] = 0
                for each microphone m
                    Y[ s, f ] = Y[ s, f ] + ( X[ m, f ] * W[ p, m, f ] )
                end
```

After the m-loop is completed, then the energy of the point p at the present frequency bin of the loop is calculated, at 90, and the frequency counter is updated, at 92. The energy value relating to each frequency for the point in loop is summated and stored in variable Energy_ThisPoint, and repeated until Energy_ThisPoint takes the total value of the energy for the point in loop.

```
            Energy_ThisPoint = Energy_ThisPoint + | Y[ s, f ] |^2
        end
```

During each iteration the maximum energy value of the points is stored, at 96, in variable Energy_MaxAllPoints, and the f counter is updated, at 98.

```
            . if ( Energy_ThisPoint > Energy_MaxAllPoints )
                . Energy_MaxAllPoints = Energy_ThisPoint
                . pMax = p
            . end
        end
```

At the end of the p-loop, once the point with highest energy has been determined, then the energy of the same point is tested, at 100, against the highest energy points of previous sectors, and the highest energy point amongst the sectors is stored in Energy_MaxAllSectors.

```
            if ( Energy_MaxAllPoints > Energy_MaxAllSectors)
                Energy_MaxAllSectors = Energy_MaxAllPoints
                sectorMax = s
                sectorPointMax = pMax
            end
        end
```

The s counter is updated, at 102, and the next sector is searched to find the highest energy point and then tested against the highest energy point found in the previous sectors, until the highest energy point amongst all the sectors is found. At this stage, the index entry belonging to the sector in which the highest energy point was found is updated.

P[sectorMax]=sectorPointMax

It is important to note that only one selected sound source location point of the sound source location point index is updated per process cycle, and the others remain the same as they were in the previous process cycle.

The sound source location point index is now updated, and is used by the beamformer module to calculate a primary beamformer output signal for each sector accordingly.

```
    . for each sector s
      p = P[ s ]
        for each frequency f
```

-continued

```
        Y[ s, f ] = 0
            for each microphone m
                Y[ s, f ] = Y[ s, f ] + ( X[ m, f ] * W[ p, m, f ] )
            end
        end
    end
```

The beamformer output signals Y[s, f] for each sector are now calculated. Next, a post-filter for each beamformer signal is calculated. The post-filter mask is calculated in two steps. First a pre-filter mask H[s,f] is calculated that includes entries of ones and zeros, as the case may be, at its frequency bins. Thereafter, the pre-filter mask is used to calculate a post-filter mask G[s,f] that would ultimately be used to filter the beamformer output signals. A duplicate of G[s,f] is kept as G_previous[s,f] for use in the next process cycle.

Broadly, H[s,f] includes a pre-filter vector for each sector. The pre-filter vector is populated with either the value 1 or the value 0 at each of its frequency bins as follows.

Figure 8:
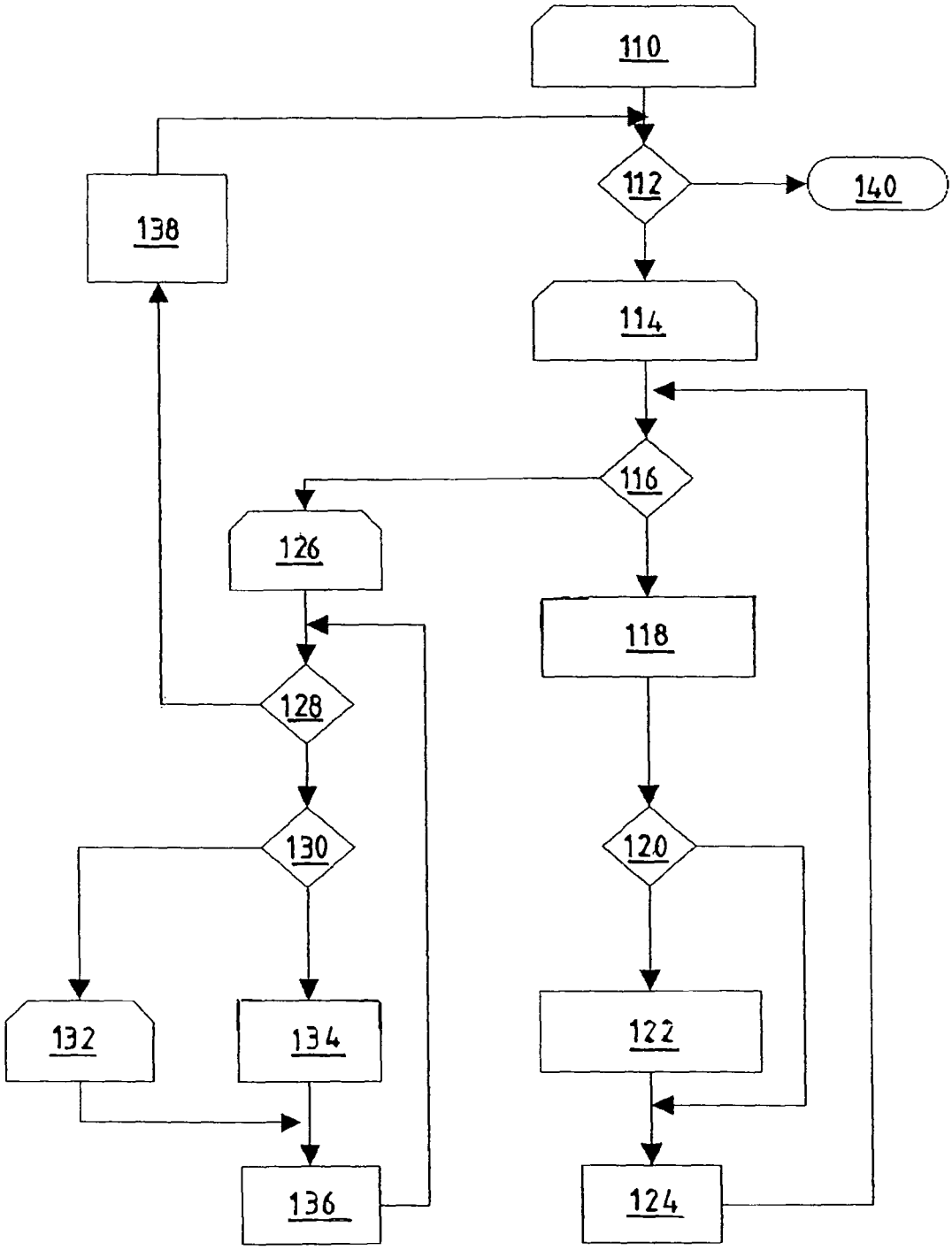
FIG. 8 shows a flow diagram of a method for calculating a pre-filter mask for beamformer output signals in accordance with one embodiment of the invention.

Referring to FIG. 8, a for-loop for each frequency bin is executed, at 110, with f as counter, at 112. Within this loop another loop for each sector s, at 114, with s as counter, at 116, is executed and the value of the element in the frequency bin f in loop of each beamformer signal is calculated at 118, and checked, at 120, to test if the value calculated is the highest compared to the values of the same frequency bins of the other beamformer sector values. At 122, a record is kept in variable maxSectors[f]=s of the sector s that has the highest value at the frequency bin in loop. The s counter is updated at 124 and the loop is repeated for all s.

```
for each frequency f
maxValue = 0
    for each sector s
        E = |Y[ s, f ]|^2
        if ( E > maxValue )
        maxValue = E
        maxSectors[f] = s
    end
end
```

When the sector having the highest value at the frequency bin in the loop is determined, the corresponding frequency bins of the pre-filter masks are populated with either the value 1 or 0 as the case may be. A for-loop is started at 126 for each sector s with counter s, at 128. At 130, the maxSectors[f] is used to check if the sector in the loop had the highest value at the frequency bin in the loop, and if it did, then the corresponding frequency bin of H[s,f] for that sector is set, at 134, to 1, and if not, then the corresponding frequency bin of H[s,f] for that sector is set, at 132, to 0. The sector counter s is updated at 136. Once the values, at the frequency bin f that is in the loop, of all the pre-filter masks for all the sector are set, at 128, then the f counter is updated, at 138, and the loop repeats for the next frequency bin.

```
for each sector s
    if ( maxSectors[f] == s )
        H[ s, f ] = 1
    else
        H[ s, f ] = 0
    end
    end
end
```

Figure 9:
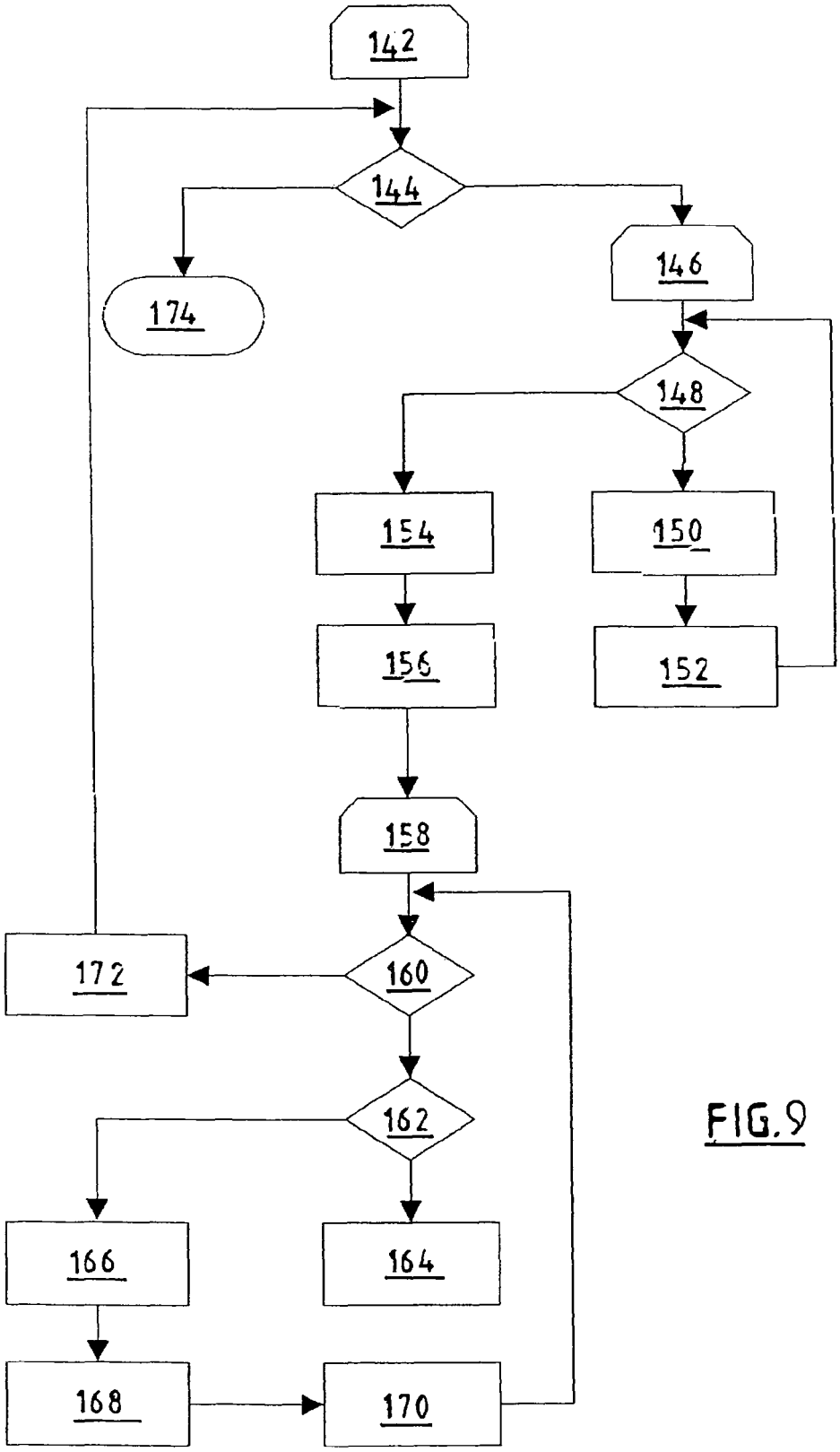
FIG. 9 shows a flow diagram for calculating a post-filter mask in accordance with one embodiment of the invention using the pre-filter mask vector in FIG. 8.

Once all the frequency bins of all the pre-filters masks are set, then the frequency loop exits, at 112, and at 140 the post-filter mask procedure is executed as illustrated in FIG. 9.

At 142, a for-loop is executed for each sector s with s as the loop counter, at 144. Within this loop, another for-loop is executed, at 146, for each frequency bin in the sub set of frequency bins f1 to f2, with f as loop counter, at 148. At 150, the values of each frequency bin in the subset f1 to f2 is added to the previous one and the f counter is updated, at 152, until the values of all the frequency bins in f1 to f2 is summated to form r[s]. At 154, the average value of the frequency bins f1 to f2 is calculated, and at 156, the average value is transformed according to a selected distribution function.

```
for each sector s
r[ s ] = 0
for each frequency f from f1 to f2
    r[ s ] = r[ s ] + H[ s, f ]
end
r[ s ] = r[ s ] / ( f2 − f1 )
pr[ s ] = 1 / ( 1 − (alpha x exp( r[s] − beta )) )
```

Thereafter, at 158, a for-loop is executed over all the frequency bins with f as loop counter, at 160. At 162, a check is performed to determine if the value of the frequency bin presently in loop of H[s,f] is equal to one, and if it is, then the corresponding frequency bin in G[s,f] is populated with the transformed average value that was calculated with the sector in loop, at 164. If the value in the frequency bin in loop of H[s,f] is equal to 0, then the corresponding frequency bin of the G[s,f] is set, at 166, to the value it had in the previous process cycle times a weighting factor for decaying the value, and the new value is saved, at 168, in G_previous[s,f]. The f loop counter is then updated, at 170. When the f loop counter reaches its final count, then the s counter is updated, at 172.

```
    for each frequency f
        . if ( H[ s, f ] = 1 )
            . G[ s, f ] = pr[ s ]
        . else
            . G[ s, f ] = gamma * G_previous[ s, f ]
        . end
        . G_previous[ s, f ] = G[ s, f ]
    end
end
```

Once g[s,f] is calculated, then it is applied, at 174, to the beamformer output signals to form the filtered beamformer output signals as Z[s,f].

```
for each sector s
    for each frequency f
        Z[ s, f ] = Y[ s, f ] * G[ s, f ]
    end
end
```

Then, the filtered beamformer output signals are combined into a single output signal Z_out[f] that is discrete in the frequency domain. The separate filtered beamformer signals are multiplied with a factor delta[s] before it is combined or added to the other filtered beamformer signals. The factors in delta[s] are used further to emphasise the stronger signals and de-emphasise the weaker signals. The values in delta[s] can be, for example, the transformed average values that were calculated for the sector.

```
for each frequency f
Z_out[ f ] = 0
  for each sector s
    Z_out[ f ] = Z_out[ f ] + ( delta[ s ] * Z[ s, f] )
  end
end
```

An Inverse Fast Fourier Transform is then performed on the output signal to convert it to a time domain signal.

z_mix_out[n]=IFFT(Z_out)

Also, an IFFT is performed on each beamformer signal separately.

for each sector output, z_sector_out[s,n]=IFFT(Z[s,f])

A noise masking signal is then calculated by selecting one of the microphone signals x[m,n], for example x[1,n], and adding it to a randomly generated white noise signal. The microphone signal from the central microphone can be used. Also, a further damping or weighting factor epsilon can be applied to for adjusting the ratio or amplitude between the signals. The same can be done for the separate sector signals, z_sector-out[s,n]

```
for each sample n
  z_mix_out[ n ] = z_mix_out[ n ] + ( epsilon * x[ 1, n ] ) +
  ( sigma * randomValue )
  for each sector s
    z_sector_out[s,n] = z_sector_out[s, n ] +
    ( epsilon * x[ 1, n ] ) + ( sigma * randomValue )
  end
end
```

The microphone array system in this embodiment of the invention also includes a sound source association module (not shown) for associating a sound source signal that is detected within a spatial reception sector with a sound source in the spatial reception sector. The sound source association module, in this example, is configured to receive a stream of sound signals from each spatial reception sector during successive processing cycles, and to validate the stream of sound source signals as a valid sound source signal if it meets a predetermined criteria. The sound source association module is configured to label the valid sound source signal and to store the sound source signal and its sound source label in a sound record or history database for later retrieval.

More specifically, the sound source signals are linked and segmented into sound source segments. In this example, the sound source signals are expected to contain speech and the sound sources are speakers. Thus, a method is described for segmenting the audio into speech utterances, and then associating a speaker identity label with each utterance.

The post-filter described above incorporates a measure of speech probability for each sector, $p_s$(speech). This probability value is computed for each process cycle. In order to segment each sector into a sequence of utterances (with intermediate non-speech segments), a filtering stage is applied to smooth these raw speech probability values over time.

One such illustrative filtering stage is described in the following description and it includes a state-machine module that has four states. Any one of the states may be associated with a sound source sector signal during each processing cycle.

As is explained in more detail below, the state-machine module is configured to compare a transformation value of each sector against a threshold value, and to promote the status of the state-machine module to a higher status if the transformation value is higher than the threshold value, and demote the status to a lower status if the transformation value is lower than the threshold value.

More specifically, the filtering is implemented as a state machine module containing four states: inactive, pre-active, active and post-active, initialised to the inactive state. A transition to the pre-active state occurs when speech activity (defined as $p_s$(speech)>0.5) occurs for a given frame. In the pre-active state, the machine either waits for a specified number of active frames before confirming the utterance in the active state, or else returns to the inactive state.

The machine remains in the active state while active frames occur, and transitions to the post-active state once an inactive frame occurs. In the post-active state, the machine either returns to the active state after an active frame, or else returns to the inactive state after waiting a specified number of frames.

This segmentation stage outputs a Boolean value for each sector and each frame. The value is true if the sector is currently in the active or post-active state, and false otherwise. In this way, the audio stream in each sector is segmented into a sequence of multi-frame speech utterances. A location is associated with each utterance as the weighted centroid of locations for each active frame, where each frame location is determined as described above.

The preceding segmentation stage produces a sequence of utterances within each sector. Each utterance is defined by the enhanced speech signal together with its location within a sector. This section describes a method to group these utterances according to the person who spoke them. In order to associate a speaker label with these utterances, it is first assumed by definition that a single utterance belongs only to a single person. From the first utterance, an initial group is created. For all subsequent utterances, a comparison is performed to decide whether to (a) associate the utterance with one of the existing utterance groups, or (b) create a new group containing the utterance. In order to associate a new utterance to an existing utterance group, a comparison function is defined based on the following available parameters:

a) The time interval during which the utterance occurred.

b) The location at which the utterance occurred.

c) The spectral characteristics of the speech signal throughout the utterance.

A range of comparison functions may be implemented based on these measured parameters. In the illustrative embodiment, a two step comparison is proposed:

i) Firstly, it is assumed that utterances that occur close to each other in both time and location belong to the same person. Proximity in time and location may be defined by comparing each to a heuristic distance threshold, such as within 30 seconds and 30 degrees of separation in the azimuth plane. If a new utterance occurs within the time and distance thresholds of the most recent from an existing utterance group, it is merged with that group.

ii) If the utterance does not pass the first comparison step for any existing group, then the utterance may be compared according to the spectral characteristics of the speech. This may be performed either using automated speaker clustering measures, or else automated speaker identification software (using either existing stored speaker models, or models trained ad-hoc on existing utterances within the group).

Following application of the above steps, the sequence of utterances will be associated into a number of groups, where each group may be assumed to represent a single person. A label (identity) may be associated with each person (utterance group) by either prompting the user to input a name, or else using the label associated with an existing speaker identification voice model.

Typically, the first time a given person uses the device, a user must be prompted to enter their name. A voice model can then be created based on the group of utterances by that person. For subsequent usage by that person, their name may be automatically assigned according to the stored voice model.

Advantageously, the system 16 uses an N-fold rotationally symmetrical microphone array, and thus enables the use of a beamformer that uses the same set of beamformer weights for calculating a beamformer output signal for each sector. This means that less beamformer weight needs to be defined for catering for all the sectors, and this saves computer memory.

Another advantage is that the processing time is reduced by performing sound source location, using SRP, over a subset of frequency bins f1 to f2, as opposed to the full range of frequency bins. Also, searching only over a subset of grid points, and updating only one sound source index position for one sector, further reduces the number of process steps and thus the process cycle time.

Another advantage of the cone described above with reference to the drawings is that it reduces the required number of microphone elements when compared to spherical and hemispherical array structures. This reduces cost and computational complexity, with a minimal loss in directivity. This is particularly so when sources can be to occupy locations distributed around the cone's centre, as in the case of people arranged the perimeter of a table.

Further, the system 16 detects periods of speech activity, and determines the location of the person relative to other people in the reception space.

The system 16 produces a high quality speech stream in which the levels of all other speakers and noise sources have been audibly reduced. Also, the system 16 is able to identify a person, where a named voice model has been stored from prior use sessions.

Extraction of a temporal sequence of speech characteristics, including, but not limited to, active speaker time, pitch, and sound pressure level, and calculation of statistics based on the above extracted characteristics, including, but not limited to, total time spent talking, mean and variance of utterance duration, pitch and sound pressure levels is advantageously able to be provided by the system.

To this end, for the group of all speaking persons, a production of a single audio channel that contains a high quality mixture of all speakers is obtained, and provision is made for a mechanism for users to control the relative volume of each speaking person in this mixed output channel.

The system 16 also permits calculation of global measures and statistics derived from measures and statistics of an individual person.

It will of course be realized that the above has been given only by way of illustrative example of the invention and that all such modifications and variations thereto, as would be apparent to persons skilled in the art, are deemed to fall within the broad scope and ambit of the invention as is herein set forth.

The invention claimed is:

1. A microphone array system for sound acquisition from multiple sound sources in a reception space, the microphone array system including:

a microphone array interface for receiving microphone output signals from an array of microphone transducers that are spatially arranged relative to each other within the reception space, the array interface including a sample-and-hold arrangement for sampling the microphone output signals of the transducers in processing cycles to form discrete time domain microphone output signals into corresponding discrete frequency domain microphone output signals;

a beamformer module operatively able to form beamformer signals associated with any one of a plurality of defined spatial reception sectors within the reception space surrounding the array of microphone transducers, the beamformer module including a set of defined beamformer weights and being configured to compute, during each processing cycle, a set of a beamformer output signals that are associated with respective reception sectors and have a defined set of frequency bins; and a post-filter module that is configured to define a pre-filter mask for each primary beamformer output signal, the post-filter module being configured to populate a frequency bin of the pre-filter mask for each primary beamformer signal with a defined value if the value of the corresponding frequency bin of the primary beamformer signal is the highest amongst same frequency bins of all the beamformer output signals, otherwise to populate the frequency bin of the pre-filter mask with another defined value.

2. A microphone array system as claimed in claim 1, in which the microphone transducers are spatially arranged relative to each other to form an N-fold rotationally symmetrical microphone array about a vertical axis.

3. A microphone array system as claimed in claim 2, in which the set of defined beamformer weights is a function of a set of defined candidate sound source location points spaced apart within one of N rotationally symmetrical spatial reception sectors associated with the N-fold rotationally symmetry of the microphone array and a function of microphone indexes of the microphone transducers, the microphone indexes being adjustable to displace the set of beamformer weights angularly about the vertical axis into association with any one of the N rotationally symmetrical spatial reception sectors, which includes a sound source location point index that is populated with a selected candidate sound source location point for each sector, wherein the beamformer module is configured so that the set of computed primary beamformer signals are associated with directions of each selected candidate sound source location point in the sound source location point index.

4. A microphone array system as claimed in claim 3, which includes a sound source location module for, during each processing cycle, updating the sound source location point index, wherein the sound source location module is configured to:

(1) update only one of the selected candidate sound source location points in the sound source location point index during each processing cycle: or, (2) determine during each processing cycle the highest energy candidate sound source location point, being the point in the direction of which the highest sound energy is received, and to note the highest energy candidate sound source location point and its associated sector; or (3) update the selected sound source location point of the reception sector within which the highest energy sound source location point is determined to correspond to the highest energy sound source location point; or (4) determine the signal energies respectively in the directions of a sub set of sound source location points in each sector localized around the selected sound source location point for each reception sector, and to update the selected sound source location point of the reception sector within which the highest energy sound source location point is determined to correspond to the highest energy sound source location point, and the signal energy of each candidate sound source location point is calculated by using a secondary beamformer signal directed to the sound source location points of the subset of sound source location points, the secondary beamformer signal being calculated over a sub set of frequency bins.

5. The microphone array system as claimed in claim 1, in which the one defined value equals one and the other defined value equals zero.

6. A microphone array system as claimed in claim 1, in which the post-filter module is configured to calculate an average value of each pre-filter mask for each primary beamformer signal, the average value being calculated over a selected subset of frequency bins, the selected subset of frequency bins corresponding to a selected frequency band, wherein the selected frequency band includes frequencies corresponding to a desired sound source, and preferably or optionally the selected frequency band include typical speech frequencies between 50 Hz to 8000 Hz.

7. A microphone array system as claimed in claim 6, in which the post-filter module is configured to calculate a distribution value for each sector according to a selected distribution function, the distribution value for each sector being calculated as a function of the average value of the pre-filter mask for that sector, and preferably or optionally the distribution function is a sigmoid function.

8. A microphone array system as claimed in claim 7, in which the post-filter module is configured to enter the distribution value for each primary beamformer output sector signal into frequency bin positions of the associated post-filter mask vector that correspond with frequency bin positions of the pre-filter mask vector having said defined value, wherein the post-filter module is configured to determine the existing values of the post-filter masks at those frequency bins that correspond with those frequency bin positions of the pre-filter mask vector that have said another defined value, and to apply to those values a defined de-weighting factor for attenuating those values during each cycle.

9. A microphone array system as claimed in claim 8, which includes applying the post-filter masks to their respective primary beamformer output signals, to form filtered beamformer output signals, and applying selected weighting factors to the beamformer output signals respectively, and the selected weighting factor for each beamformer output signal is determined as a function of the average value of its pre-filter vector mask and preferably or optionally the selected weighting factor for each beamformer signal is independently adjustable by a user for effectively adjusting the volume of each sector independently.

10. A microphone array system as claimed in claim 9, in which the mixer module is configured to compute a first noise masking signal that is a function of a selected one of the time domain microphone input signals and a first weighting factor, and to apply a generated white noise signal to the time domain output signal to form a first noise masked output signal, and the mixer module is configured to compute a second noise masking signal that is a function of randomly generated values between selected values and a second selected weighting factor, and to apply the second noise masking signal to the first noise masked output signal to form a second noise masked output signal.

11. A microphone array system as claimed in claim 10, which includes a sound source association module for associating a stream of sounds that is detected within a spatial reception sector with a sound source label allocated to the spatial reception sector, and to store the stream of sounds and its label if it meets predetermined criteria, and the criteria for each spatial reception sector is a function of the average value of the pre-filter mask calculated for said sector.

12. A microphone array system as claimed in claim 11, in which the sound source association module includes a name index having name index entries for the sectors, each name index entry being for logging a name of a user associated with a spatial reception sector.

13. A microphone array system as claimed in claim 12, which further includes a user interface for permitting a user to configure the sound source association module; and the sound source association module includes a state-machine module that includes four states namely an inactive state, a pre-active state, an active state, and a post-active state, and the state-machine is configured to apply a criteria to a stream of sounds from a reception sector, and to promote the status of the state-machine to a higher status if successive sound signals exceed a threshold value, and to demote the status to a lower status if the successive sound signals are lower than the threshold value, and the state-machine is configured to store the sound source signal when it remains in the active state or the post-active state and to ignore the signal when it remains in the inactive state or the pre-active state; and a network interface for connecting remotely to another microphone array system over a data communication network.

14. A microphone array system as claimed in claim 2, in which the microphone array includes a 6-fold rotational symmetry about the vertical axis defined by seven microphone transducers that are arranged on apexes of a hexagonal pyramid, six base microphone transducers being arranged on apexes of a hexagon on a horizontal plane, and one central microphone transducer being axially spaced apart from the base microphone transducers on the apex of the vertical axis of the microphone array.

15. A method for processing microphone array output signals with a computer system, the method including:

receiving microphone output signals, in a microphone array interface, from an array of microphone transducers that are spatially arranged relative to each other within a reception space, the array interface including a sample-and-hold arrangement for sampling the microphone output signals of the transducers in processing cycles to form discrete time domain microphone output signals into corresponding discrete frequency domain output signals;

forming beamformer signals with a beamformer, the beamformer signals being associated with any one of a plurality of defined spatial reception sectors within the reception space surrounding the array of microwave transducers, the beamformer module including a set of defined beamformer weights and being configured to compute, during each processing cycle, a set of primary beamformer output signals that are associated with respective reception sectors and have a defined set of frequency bins; and defining a pre-filter mask for each primary beamformer output signal with a post filter module and, with the post filter module, populating a frequency bin of the pre-filter mask for each primary beamformer signal with a defined value if the value of the corresponding frequency bin of the primary beamformer signal is the highest amongst same frequency bins of all the beamformer output signals, otherwise populating the frequency bin of the pre-filter mask with another defined value.

16. A method for processing an array of discrete signals with a computer system, the discrete signals having a defined set of frequency bins, the method including:

defining a pre-filter mask for each discrete signal, wherein a post-filter module is configured to populate a frequency bin of the pre-filter mask for each discrete signal with a defined high value if the value of the corresponding frequency bin of the discrete signal is the highest amongst same frequency bins of all the discrete signals, otherwise to populate the frequency bin of the pre-filter mask with another defined low value;

defining a distribution value for each discrete signal according to a selected distribution function as a function of the average value of the pre-filter mask for that discrete signal over a selected sub-set of frequency bins;

populating for each discrete signal a post-filter mask vector with the distribution value of the discrete signal at those frequency bins corresponding to those frequency bins of its pre-filter mask vector having a defined high value, and multiplying the remaining frequency bins with a de-weighting factor for attenuating the remaining frequency bins during each cycle; and applying the post-filter masks to their respective discrete signals to form filtered discrete output signals.

17. A method as claimed in claim 16, in which determining an indicator value includes defining a pre-filter mask for each discrete signal by populating a frequency bin of the pre-filter mask for each discrete signal with a defined value if the value of the corresponding frequency bin of said discrete signal is the highest amongst same frequency bins of all the discrete signals, otherwise to populate the frequency bin of the pre-filter mask with another defined value, in which each indicator value equals an average value of each pre-filter mask for each discrete signal, the average value being calculated over a selected subset of frequency bins, the selected subset of frequency bins corresponding to a selected frequency band associated with a type of sound sources that are to be acquired by a microphone array system, wherein the one value is defined as equal to one and the other value equal to zero, and preferably or optionally defining the selected frequency band to correspond to selected frequencies of human speech.

18. A method as claimed in claim 17, in which determining a distribution value for each discrete signal includes calculating for each discrete signal a distribution value according to a selected distribution function, which distribution value for each sector is calculated as a function of the indicator value of the pre-filter mask for said discrete signal, and preferably or optionally the distribution function is a sigmoid function.

19. A method as claimed in claim 18, which includes entering the distribution value for each discrete signal into frequency bin positions of the associated post-filter mask vector that correspond with frequency bin positions of the pre-filter mask vector having a value of one; and populating those frequency bins of the post-filter mask vector that correspond with those frequency bin positions of the pre-filter mask vector that have a zero value with a value corresponding to its value from a previous process cycle attenuated by a defined weighting factor.

20. A computer system that includes computer readable instructions, which when executed by the computer system, causes the computer system to perform the method according to claim 15.

* * * * *